US010246837B2

(12) United States Patent
Lorenz

(10) Patent No.: US 10,246,837 B2
(45) Date of Patent: Apr. 2, 2019

(54) METHOD AND APPARATUS FOR CUTTING LINEAR TRENCHES IN CONCRETE

(71) Applicant: Alexander Lorenz, Wyckoff, NJ (US)

(72) Inventor: Alexander Lorenz, Wyckoff, NJ (US)

(73) Assignee: Alexander Lorenz, Wycoff, NJ (US)

( * ) Notice: Subject to any disclaimer, the term of this patent is extended or adjusted under 35 U.S.C. 154(b) by 0 days.

(21) Appl. No.: 16/008,575

(22) Filed: Jun. 14, 2018

(65) Prior Publication Data

US 2018/0347124 A1 Dec. 6, 2018

Related U.S. Application Data

(63) Continuation-in-part of application No. 15/881,303, filed on Jan. 26, 2018.

(60) Provisional application No. 62/499,484, filed on Jan. 27, 2017, provisional application No. 62/600,566, filed on Feb. 24, 2017.

(51) Int. Cl.

| | |
|---|---|
| ***E01C 23/088*** | (2006.01) |
| ***B24B 7/18*** | (2006.01) |
| ***B24B 23/00*** | (2006.01) |
| ***B28D 1/24*** | (2006.01) |
| ***E04F 21/00*** | (2006.01) |
| ***E01C 23/09*** | (2006.01) |

(52) U.S. Cl.

CPC ..... *E01C 23/088* (2013.01); *B24B 7/186* (2013.01); *B24B 23/005* (2013.01); *B28D 1/24* (2013.01); *E01C 23/096* (2013.01); *E04F 21/0015* (2013.01); *E01C 23/0933* (2013.01); *E04F 21/0076* (2013.01); *E04F 21/0092* (2013.01)

(58) Field of Classification Search

CPC .. E01C 23/088; E01C 23/0933; E01C 23/096; B24B 7/186; B24B 23/055; B28D 1/24; E04F 21/0015; E04F 21/0076; E04F 21/0092

USPC ..... 404/72, 75, 90, 93, 94; 125/12

See application file for complete search history.

(56) References Cited

U.S. PATENT DOCUMENTS

| | | | | |
|---|---|---|---|---|
| 5,429,420 | A * | 7/1995 | Johnson | B23D 47/12 125/13.01 |
| 9,027,542 | B2 * | 5/2015 | Ronzello, Sr. | B28D 7/02 125/13.01 |
| 9,844,868 | B1 * | 12/2017 | Abbey | B25D 17/32 |
| 2005/0191133 | A1 * | 9/2005 | Purcell | G02B 6/504 405/157 |

(Continued)

*Primary Examiner* — Raymond W Addie

(74) *Attorney, Agent, or Firm* — Davis, Malm & D'Agostine, P.C.; Richard L. Sampson

(57) ABSTRACT

A portable apparatus and method for cutting linear trenches in a concrete ground surface includes two bars extending in parallel spaced relation along the concrete with an elongated track removably fastened and extending orthogonally thereto. A trolley supporting a motor-driven cutting wheel is movably engaged with the track. A depth adjuster alternately lowers and raises the cutting wheel to engage and disengage the concrete while the trolley follows contours of the concrete to cut a kerf of uniform depth. The track is selectively movable to spaced locations along the lengths of the two bars to cut a first plurality of parallel kerfs in a first direction. The apparatus is rotatable about a vertical axis to cut a second plurality of parallel kerfs oriented in a second direction at a predetermined angle, e.g., 90 degrees, to the first direction, to form a simulated tile pattern in the concrete.

28 Claims, 23 Drawing Sheets

(56) References Cited

U.S. PATENT DOCUMENTS

| | | | | |
|---|---|---|---|---|
| 2006/0053629 | A1* | 3/2006 | Martin | B23D 59/006 30/123 |
| 2010/0043767 | A1* | 2/2010 | Marsic | B23D 47/12 125/13.01 |
| 2010/0126327 | A1* | 5/2010 | Cabral | B28D 1/048 83/835 |
| 2014/0270952 | A1* | 9/2014 | Karsten | E01C 23/088 404/75 |
| 2016/0332330 | A1* | 11/2016 | Carlsson | B28D 1/045 |
| 2017/0274489 | A1* | 9/2017 | Baratta | B23D 59/001 |

* cited by examiner

METHOD AND APPARATUS FOR CUTTING LINEAR TRENCHES IN CONCRETE

RELATED APPLICATION

This application is a Continuation-In-Part of U.S. patent application Ser. No. 15/881,303, entitled METHOD AND APPARATUS FOR CUTTING NON-LINEAR TRENCHES IN CONCRETE, filed on Jan. 26, 2018, which claims the benefit of U.S. Provisional Patent Application Ser. No. 62/499,484, entitled MACHINE FOR GRINDING NON-LINEAR TRENCH INTO CONCRETE—501, filed on Jan. 27, 2017, and which claims the benefit of U.S. Provisional Patent Application Ser. No. 62/600,566, entitled APPARATUS FOR CUTTING LINE PATTERNS INTO CONCRETE—EXTENDED, filed on Feb. 24, 2017, the contents all of which are incorporated herein by reference in their entirety for all purposes.

BACKGROUND

Technical Field

This invention relates to an apparatus and method for cutting non-linear trenches into concrete decks and floors in walk-behind fashion to make the resulting concrete resemble natural stone or flagstone pavers.

Background Information

Concrete is one of the most common building materials in the world. It is used for sidewalks, foundations, roads and numerous other applications. One common application of concrete is as a material for flooring, both indoors and outdoors, e.g., by pouring concrete into a preformed shape by use of forms fabricated from wood or other suitable materials. Over time, horizontal concrete surfaces (concrete ground surfaces), especially outdoors, suffer from deterioration due to aging, freeze-thaw cycles and other environmental factors. In particular, freeze-thaw cycles and the resultant thermal expansion/contraction create cracks in outdoor concrete surfaces such as sidewalks and roads, and cause it to crumble. Various approaches have been devised to repair these cracks in the hope of prolonging the useful life of these outdoor concrete surfaces. For example, cracks can be cleared of debris, e.g., using hand-held electric grinders and the like, and then filled with caulk or other flexible fillers. Such repairs, however, tend to be unsightly and the caulk tends to dry out and require periodic replacement.

Other attempts to prolong the life of outdoor concrete surfaces involve using conventional grinders to make linear cuts in the concrete to form joints that allow for expansion and that provide a controlled crack direction (following the joint which makes the concrete thinner along its length). However, conventional grinders and saws used for this purpose, namely, for making fresh cuts in concrete without following pre-existing cracks, tend to be limited to cutting straight lines. Conventional handheld grinders also tend to be difficult to operate for extended periods of time, forcing the user to be hunched over in close proximity to the cutting wheel.

Moreover, the foregoing approaches produce surfaces with obviously repaired cracks and linear cuts of limited aesthetic appeal. Thus, a need exists for a system and method for restoring concrete surfaces that addresses the aforementioned issues.

SUMMARY

In an aspect of the present invention, a walk-behind apparatus for cutting non-linear trenches in concrete includes a frame supported by at least three ground engaging wheels, including one or more fixed direction wheels at a front end portion of the frame disposed to rotate on a fixed axis of rotation, and one or more multi-directional wheels at a rear end portion of the frame disposed to rotate on one or more movable axes of rotation, to permit the frame to rotate about a substantially vertical axis passing through the frame normal to the ground. A handle at the rear end portion of the frame is engageable by a user walking behind the frame for pushing the apparatus forward and/or for steering the apparatus by pushing the handle left or right. A motor-driven ground-engaging cutting wheel has a cutting wheel axis of rotation, a diameter D in a range of from about 5 inches to about 20 inches, and a cutting portion having a width w in a direction parallel to the cutting wheel axis of rotation within a range of from about 0.5 inches to about 1.5 inches. The cutting wheel axis of rotation is substantially parallel to the fixed axis of rotation and extends notionally through the fixed direction wheels. The cutting wheel is disposed within a disc-shaped protective shroud sized and shaped to contain a majority of the cutting wheel therein during operation. The protective shroud is disposed in view of the user to permit the user to visually align the shroud and cutting wheel with a non-linear path on the ground while pushing and/or steering, to guide the cutting wheel along the non-linear path.

In particular embodiments, an additional aspect of the present invention includes the cutting wheel having circumferentially spaced metallic segments, the segments each having a cutting surface of convex cross-section in a plane parallel to the cutting wheel axis of rotation, so that during operation, the metallic segments are configured to cut a kerf in a concrete ground surface while the convex cross-section permits the cutting wheel to ride up and/or into side walls of the kerf while steering to avoid binding.

In another aspect of the invention, a method for restoring a concrete ground surface by forming portions resembling natural stone, pavers or flagstone, includes use of the apparatus of either of the foregoing aspects, in which a user engages the handle to steer the apparatus to a desired location on the concrete ground surface. While engaging the handle, the user visually aligns the shroud and cutting wheel with a non-linear path on the concrete ground surface, and actuates the cutting wheel to rotate about the cutting wheel axis of rotation. The cutting wheel is then engaged with the concrete ground surface to cut a kerf, while the user walks behind and steers the apparatus to guide the cutting wheel along the non-linear path.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
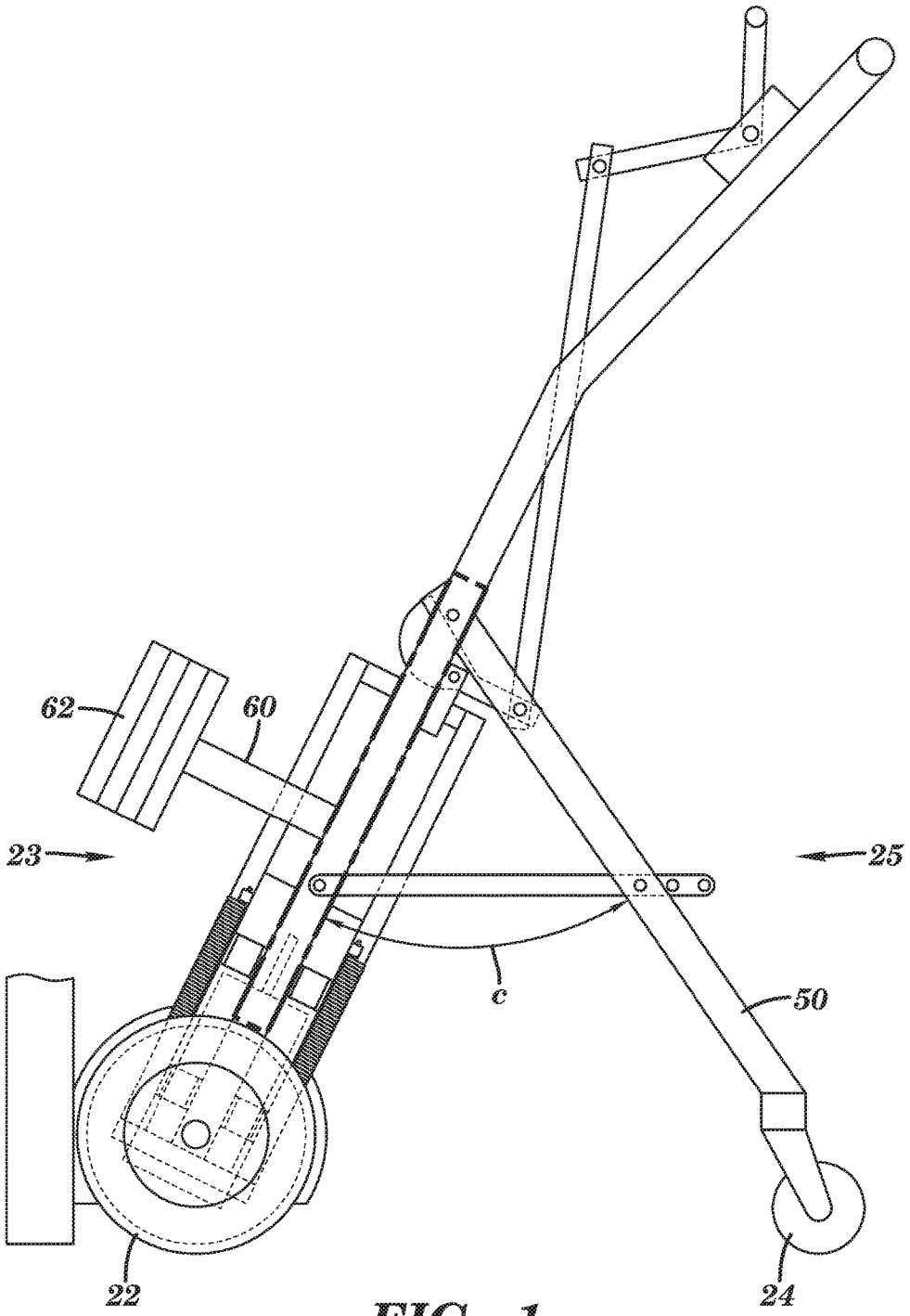
FIG. 1 is a left-hand elevational side view of an embodiment of the present invention.
Figure 2:
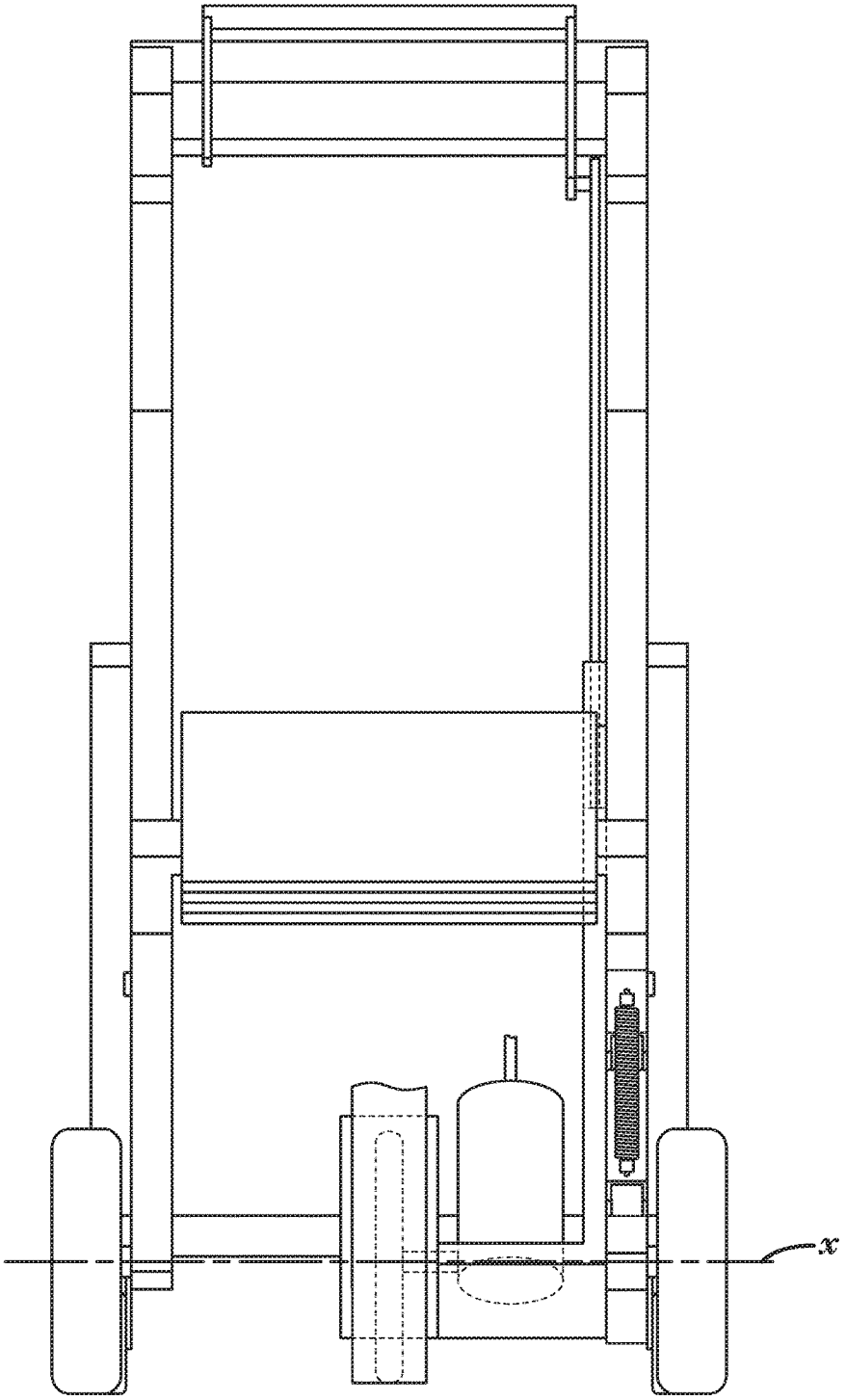
FIG. 2 is a front view of the embodiment of FIG. 1.
Figure 3:
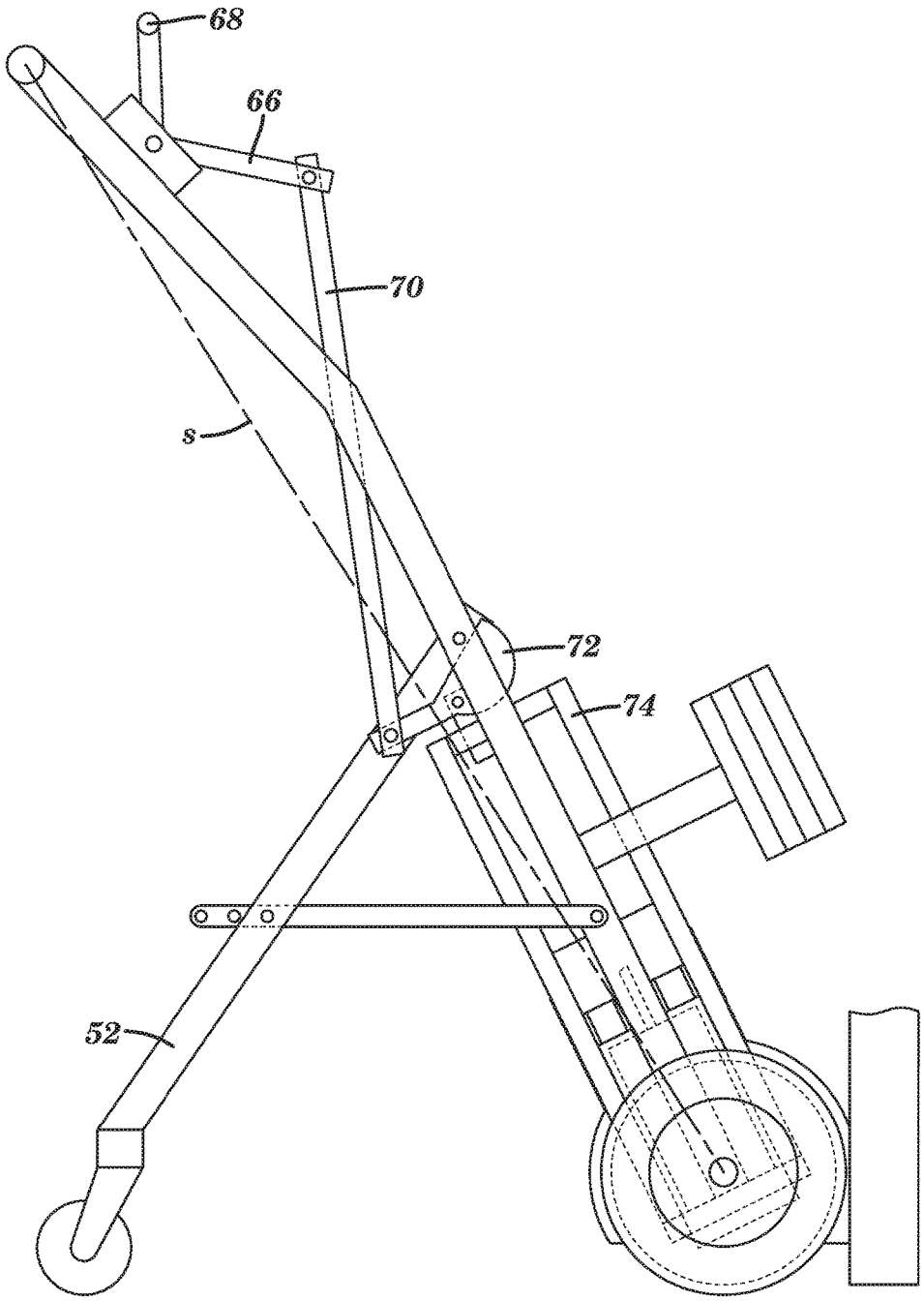
FIG. 3 is a right-hand elevational side view of the embodiment of FIGS. 1 and 2.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

Terminology

As used in the specification and in the appended claims, the singular forms "a", "an", and "the" include plural referents unless the context clearly indicates otherwise. Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

General Overview

In particular embodiments, a method and apparatus is provided for allowing an operator to cut non-linear trenches (kerfs) into concrete decks and floors in walk-behind fashion to make the resulting concrete resemble natural stone or flagstone pavers. In particular embodiments, the apparatus include a relatively large diameter segmented grinding wheel configured to produce kerfs of various depths with generally arcuate or concave cross section of various radii. These kerfs and the configuration of the apparatus serves to provide relatively low transverse forces on the grinding wheel to help prevent the wheel from binding in the kerf as the apparatus is steered to produce the non-linear cuts, while the grinding wheel is configured to accommodate remaining transverse forces. These aspects enable the grinding wheel to be relatively large diameter, for enhanced efficiency and relatively long useful life, while still being able to efficiently cut along non-linear paths. A handle-actuated depth gauge allows the operator to move the grinding wheel into and out of the concrete at various predetermined depths. Particular embodiments also include an integrated dust collector.

The present inventor has recognized that when concrete surface repair may be necessary or desirable for structural or aesthetic purposes, it may be desirable to do so in manner that changes the surface shape, and optionally color, to one that resembles natural stones or pavers. Since natural stone and pavers typically have irregular sizes and shapes with non-linear edges, it would be desirable to cut irregular and non-linear patterns into the surface of the concrete in order to achieve the desired resemblance. The inventor further recognized that prior to the invention there was no wheel-supported (walk-behind) or otherwise useful device available that would allow the operator to make these non-linear cuts in a consistent and operator-friendly manner.

For example, it was recognized that one type of commercially available device is a walk-behind floor cutting saw made for straight cuts, such as to cut contraction/control joints. These cuts are relatively deep and narrow requiring relatively large diameter, thin blades, e.g., ⅛" wide by 20" in diameter. One skilled in the art would recognize that deviations from a straight cut would tend to bind the blade against the walls of the kerf, potentially damaging and/or shattering the blade. Conventional hand-held floor cutting saws are similarly configured for straight cuts.

Conventional specialty saws may allow a user to follow pre-existing (e.g., non-linear) cracks. However, these saws are generally not adapted for cutting new non-linear trenches. It was further recognized that conventional hand-grinders would generally be incapable of providing desired levels of efficiency in a high volume and/or large scale application, as the operator would quickly tire of holding and operating the grinder.

The instant inventor recognized that in order to cut kerfs in concrete ground surfaces of consistent depth along non-linear paths, without binding and/or shattering the grinding wheel, at least two issues had to be overcome:

A. The tool should be maneuverable in a fashion that allows the cutting wheel to follow an irregular, non-linear path while reducing as much as possible, lateral forces on the wheel during a turn. In other words, transverse forces generated when the operator turns the wheel to the left or to the right to deviate from a straight path, would need to be minimized, since a wheel that is pushed transversely or at an angle to its plane of rotation tends to bind against the trench (kerf) subjecting it to damage.

B. Since some transverse forces must be expected in some applications when cutting non-linear kerfs, the wheel should be configured to accommodate some lateral forces without damage.

Referring now to the Figures, embodiments of the present invention will be described in detail.

Figure 12:
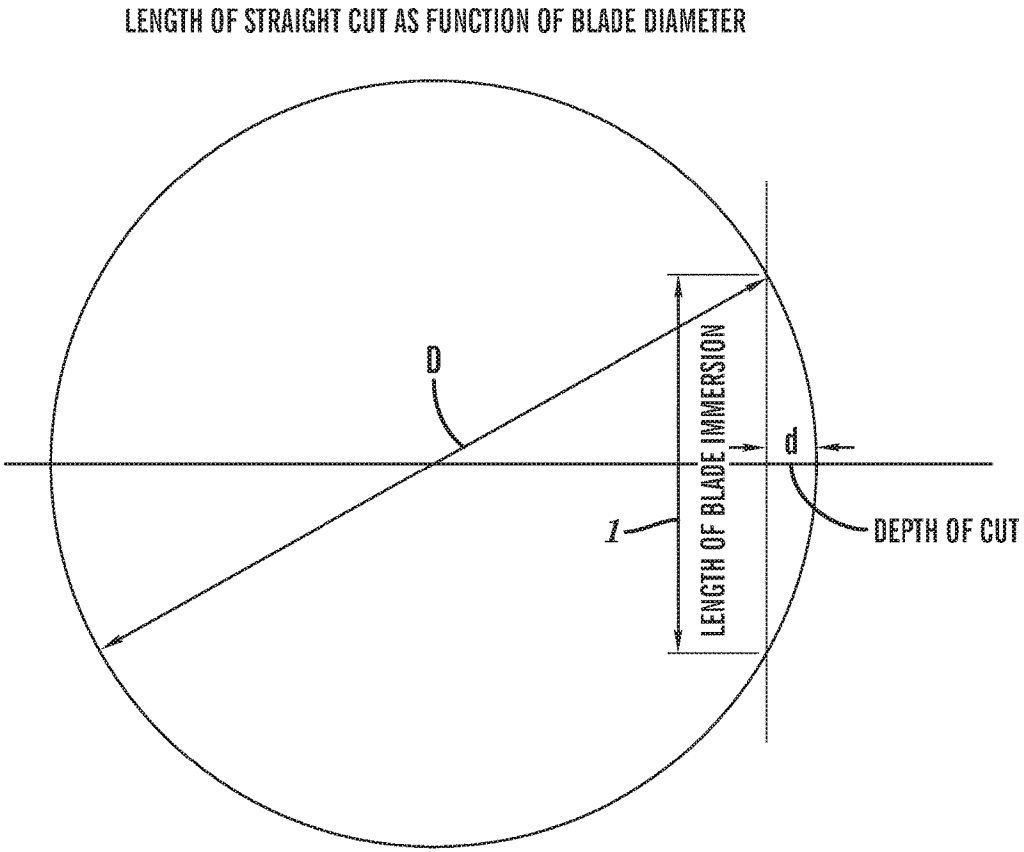
FIG. 12 is a graphical representation of the length of blade immersion in a kerf as function of blade diameter in accordance with embodiments of the present invention.
Figure 13:
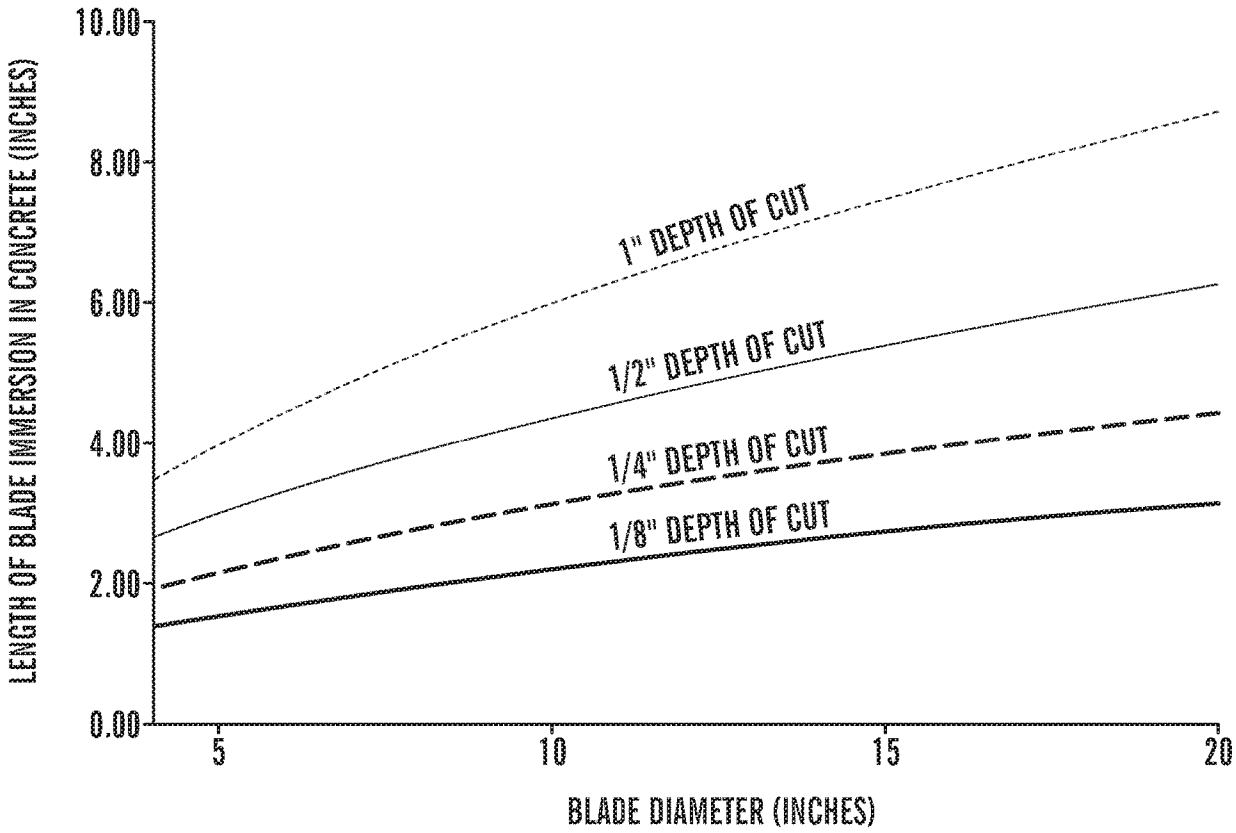
FIG. 13 is a graphical representation of length of blade immersion as a function of blade diameter at various depths of cut.
Figure 14:
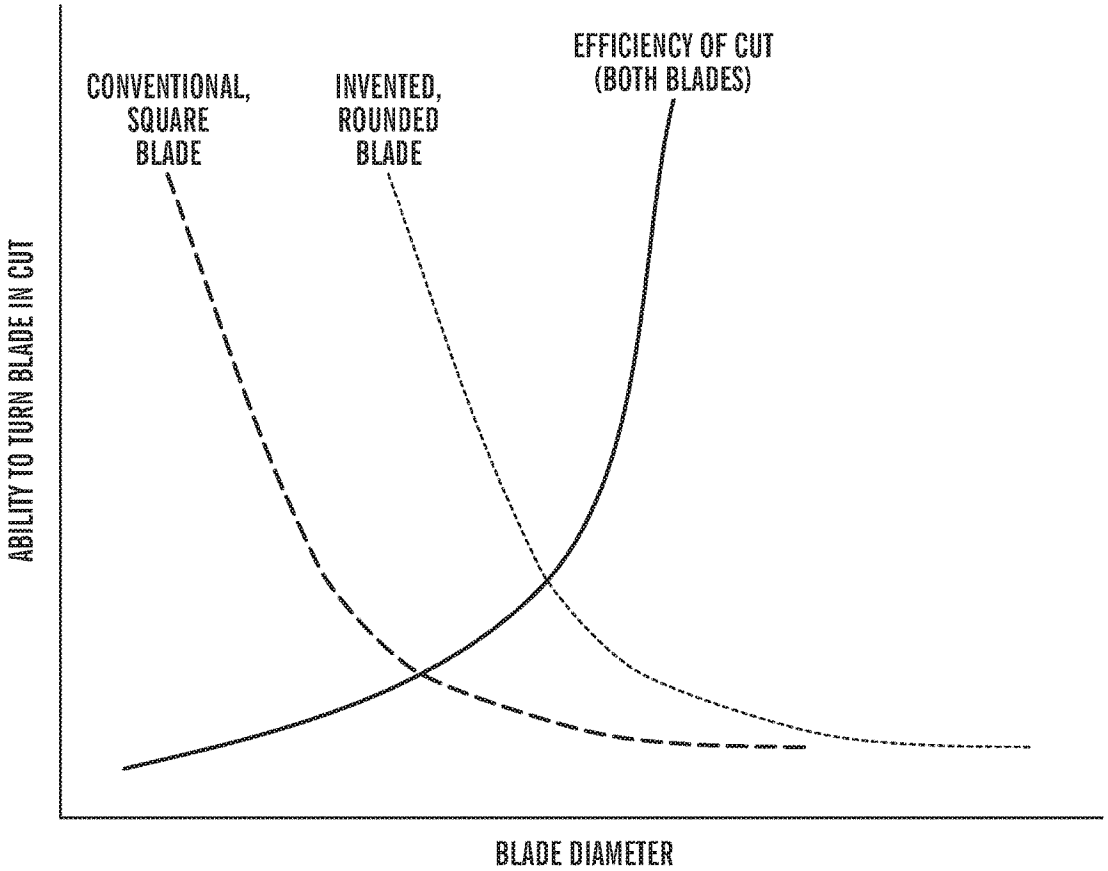
FIG. 14 is a graphical representation of relative ability to execute non-linear cuts as a function of blade diameter, for blades of convex and rectilinear cross-section.

Turning initially to FIGS. 12-14, the instant inventor has recognized that the diameter of the cutting (or grinding) blade is generally proportional to cutting efficiency, since a wheel with a larger diameter tends to have a longer useful life and tends to produce smoother and more uniformly smooth kerfs than a wheel of smaller diameter. Conversely, the inventor has also recognized that the diameter of the cutting wheel is inversely proportional to the ability to cut non-linear kerfs, because of the longer length of blade immersion of larger radius wheels.

In this regard, as shown in FIG. 12, the diameter D of a cutting wheel, used to cut a kerf of depth d, necessarily has a length of blade immersion 1. It can then be recognized that for a given depth d, the length of blade immersion 1 increases with the diameter D. So while a larger radius offers advantages in terms of wheel life, ease of use, and smoothness of the resulting kerfs, the longer length of blade immersion 1 tends to limit the ability to make non-linear kerfs due to a tendency of conventional cutting wheels to bind against the wall of the kerf when the user attempts to steer away from a straight (linear) cut, as will be discussed in greater detail hereinbelow. FIG. 13 is a graph showing the length of blade immersion 1 on the y-axis, as a function of blade diameter D on the x-axis, for a variety of cutting depths d.

In light of the foregoing, it will be recognized that an aspect of embodiments of the present invention is the provision of relatively large diameter cutting/grinding wheels that are capable of being steered during operation to produce non-linear kerfs. FIG. 14 is an illustration showing the relatively ability of both conventional cutting wheels and cutting wheels of the present invention, to product non-linear kerfs, as a function of wheel diameter d. The inventive embodiments thus provide the efficiency of a relatively large diameter cutting blade, along with the ability to turn that is generally associated with a relatively small diameter cutting blade. Particular embodiments accomplish this by providing relatively wide, and in many cases, radiused, cutting surfaces, as will be discussed hereinbelow with respect to FIGS. 6 and 7.

As shown in FIGS. 1-5, a walk-behind apparatus 10 for cutting non-linear trenches in concrete includes a frame 20 supported by at least three ground engaging wheels. In particular embodiments, frame 20 includes one or more (e.g., two as shown) fixed direction wheels 22. (FIGS. 2 and 5) at a front end portion 23 of the frame. Wheels 22 are disposed to rotate on a fixed (virtual) axis of rotation shown as axis x in FIGS. 2 and 5. One or more (e.g., two as shown) multi-directional wheels 24 (FIGS. 1 and 5) are disposed at a rear end portion 25 of the frame and are configured to rotate on movable axes of rotation. A handle 30, e.g., approximately 48 inches above the ground in particular embodiments, is disposed at the rear end of the frame 20 is engageable by a user walking behind the frame for pushing the apparatus forward and for steering the apparatus by pushing the handle left or right.

In particular embodiments, the frame 20 is foldable to facilitate storage and transportation, e.g., the frame includes articulating members configured to alternately move the rear end portion 25 away from the front end portion 23 into an operational position, and to move the rear end portion 25 toward the front end portion 23 into a closed, storage position. Referring to FIG. 1, in a particular exemplary embodiment, the articulating members include articulating legs 50 and 52, which pivot along the direction of arrow c between an open position as shown, to a closed position as shown in phantom. Moreover, as best shown in FIG. 5, in particular embodiments legs 50 and 52 are fastened to one another with a substantially horizontal crossbar 54 that supports wheels 24, to form a U-shaped sub-frame.

Figure 8:
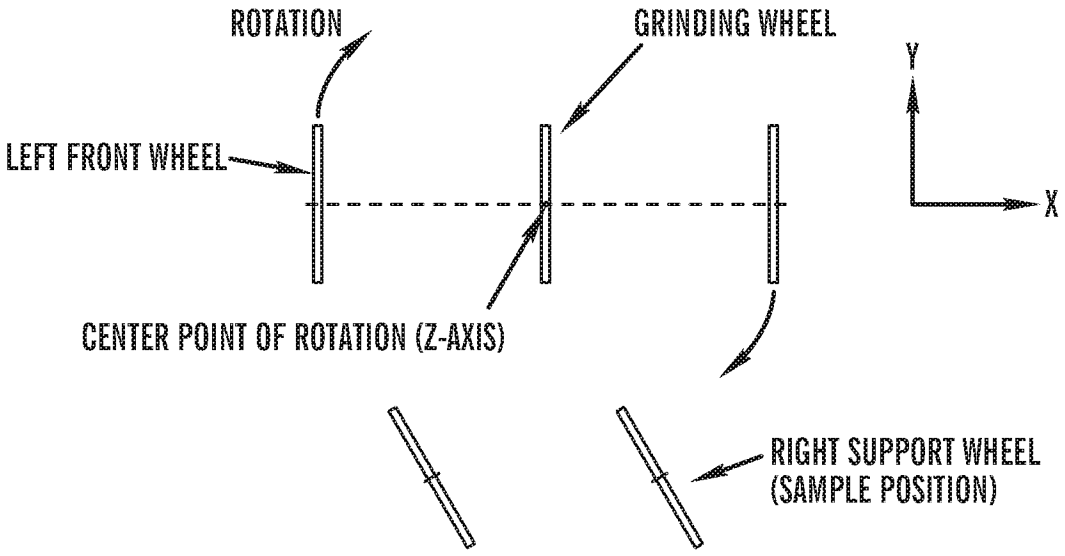
FIG. 8 is a schematic plan view of wheel positions of the embodiments of FIGS. 1-5 during operation.
Figure 11:
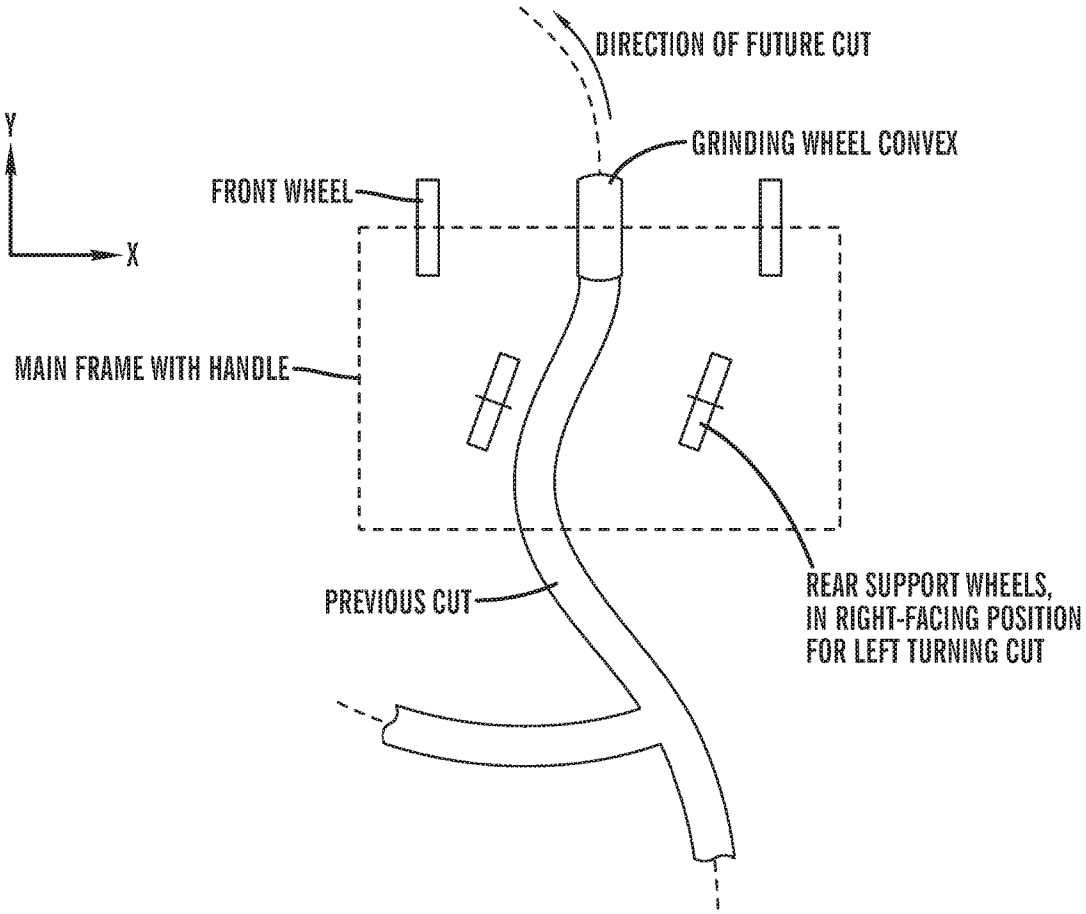
FIG. 11 is a view similar to that of FIG. 8, including a non-linear kerf produced by embodiments of the present invention.

In the embodiment shown, multi-directional wheels 24 are held by free spinning (swivel) castors that permit the wheels' axes of rotation to be rotated 360 degrees about a vertical (z) axis. As best shown in FIGS. 8 and 11, the ground engaging wheels 22 and 24 define an x-y plane (e.g., a substantially horizontal plane) extending along the concrete ground surface within which the kerf(s) is being cut, and permit the frame to rotate about a z-axis (e.g., vertical axis) passing through the frame normal to the x-y plane. For example, referring to FIG. 8, the apparatus 10 may be rotated in the clockwise (right hand) direction about a z-axis running through the center of a cutting wheel 26 by pushing the handle 30 to the left as shown at arrow a in FIG. 5. The user may push the handle 30 to the right to execute a counterclockwise (left hand) turn.

Figure 5:
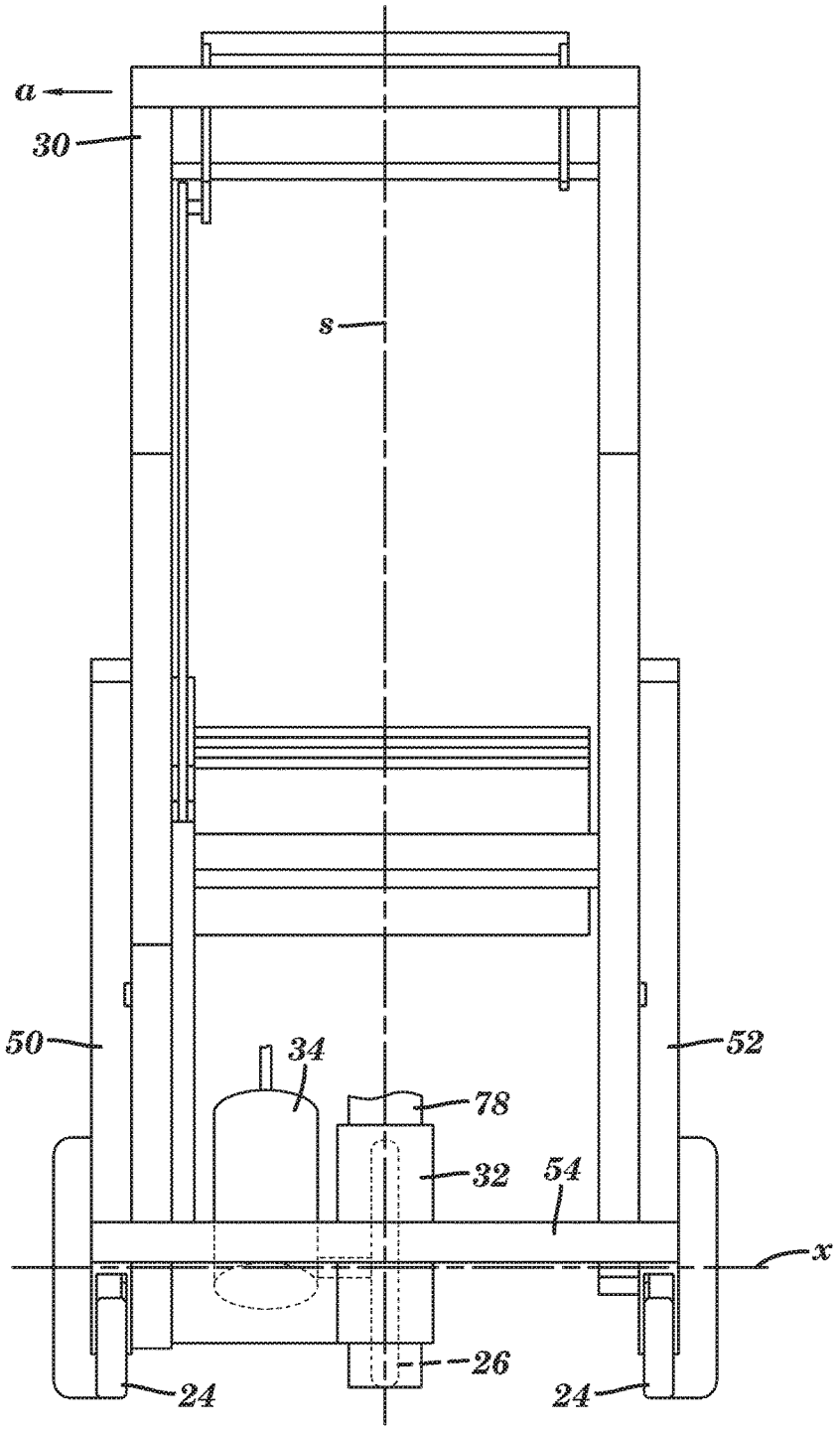
FIG. 5 is a rear view of the embodiments of FIGS. 1-4.
Figure 7:
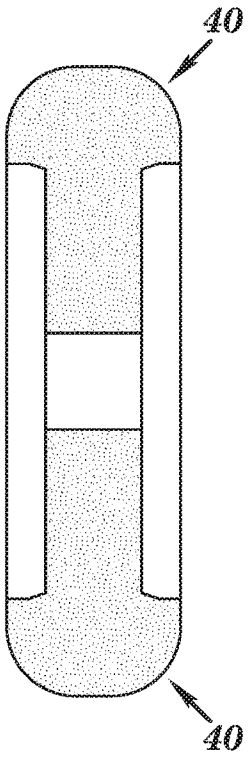
FIG. 7 is a cross-sectional view taken along 7-7 of FIG. 6.
Figure 6:
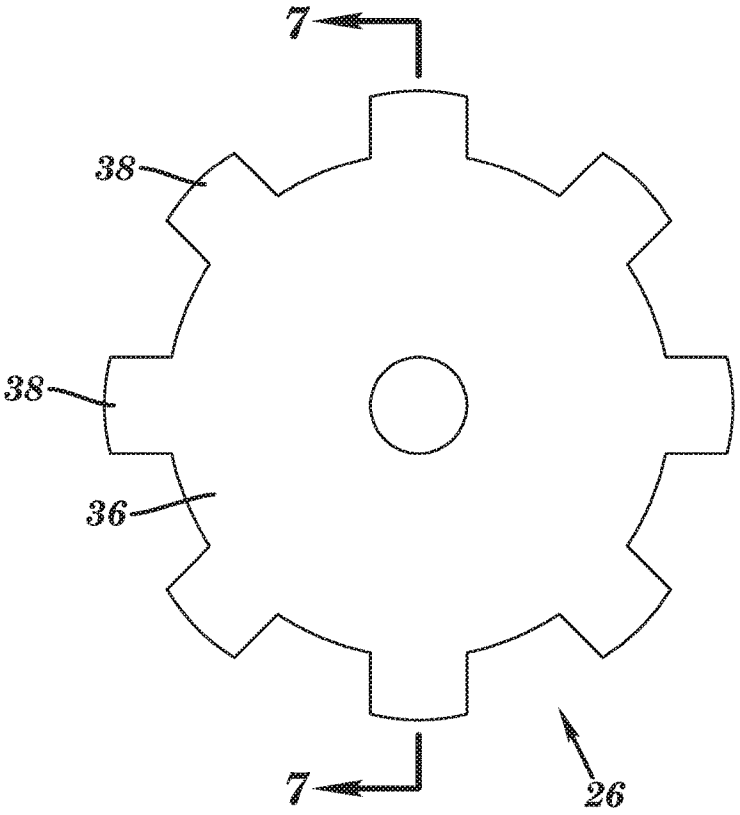
FIG. 6 is a schematic side view of a cutting wheel usable in the embodiment of FIGS. 1-5.

As best shown in FIGS. 5-7, cutting wheel 26 is disposed at the front end portion of the frame 20, with a cutting wheel axis of rotation that is substantially parallel to the fixed axis of rotation x of wheel(s) 22. In particular embodiments, the cutting wheel 26 is disposed so that it overlaps with wheel(s) 22 when viewed along the x-axis. In particular embodiments as shown, the overlap is such that the axis of rotation of wheel 26 extends notionally through wheel(s) 22. Moreover, in the particular embodiment shown, cutting wheel 26 is disposed substantially equidistantly between the pair of wheels 22 and is approximately the same diameter as wheels 22. The cutting wheel 26 may also be disposed within a substantially disc-shaped protective shroud 32 sized and shaped to contain a majority of the cutting wheel therein during concrete cutting operation.

As also shown in FIG. 5, cutting wheel 26 is driven by a motor 34 disposed in spaced relation from wheel 26 along the cutting wheel axis. This spaced orientation along with the open configuration of frame 20 provides a user walking behind the frame while engaging handle 30 with a clear line of sight s (FIGS. 3 and 5) extending from handle 30 through frame 20 to the shroud 32. The clear line of sight permits the user to visually align the shroud and cutting wheel with a non-linear path on the ground to guide the cutting wheel along the non-linear path by pushing and steering the frame.

Moreover, while motor 34 may take any of a number of conventional configurations, in particular embodiments, motor 34 may take the form of a conventional handheld grinder which is removeably supported by frame 20 as shown. In these embodiments, motor 34 and the cutting wheel 26 driven thereby form a substantially conventional unitary assembly that may be easily fastened to the frame for use as shown and described herein, while being easily removed therefrom to facilitate maintenance and/or replacement. For example, this unitary assembly may take the form of a commercially available handheld grinder of the type configured to use grinding wheels of approximately 7" diameter.

Referring now to FIGS. 6-7, in particular embodiments, cutting wheel 26 is a segmented grinding wheel having a metallic body 36 and a plurality of circumferentially spaced metallic segments 38. Metallic segments 38 each have a cutting surface of convex cross-section in a plane parallel to the cutting wheel axis of rotation, and which include a layer of abrasive grains 40 brazed, welded, or otherwise secured thereto in a conventional manner. The use of metallic segments 38, rather than conventional bonded abrasive grinding wheels made from a matrix of coarse abrasive particles pressed and bonded together, helps to maintain the desired curvature of the wheel (and the kerf) as discussed hereinbelow. In this regard, the instant inventor recognized that bonded abrasive wheels are highly sacrificial, with abrasive particles continually being worn off the surface of the wheel during operation. The inventor recognized that this sacrificial nature would quickly attenuate any cross-sectional curvature, making it difficult to maintain the desired concavity of the wheel/kerf as the wheel wears. On the other hand, the use of segments 38, including fabricating them from a mechanically tough metallic material with a brazed or welded cutting layer 40, permits the segments to maintain their convex geometry even after prolonged cutting operation. In various embodiments, wheel 36 has a diameter D in a range of from about 5 inches to 20 inches, with particular embodiments having a diameter D in a range of from about 6 inches to 8 inches, for cutting depths of in a range of from about 0.25 inches to 0.5 inches. In these embodiments, the width w of the cutting portion (segments) 38 is within a range of from about 0.5 inches to about 1.5 inches, with particular embodiments having a width w within a range of from about 0.75 inches to 1.25 inches.

Figure 9:
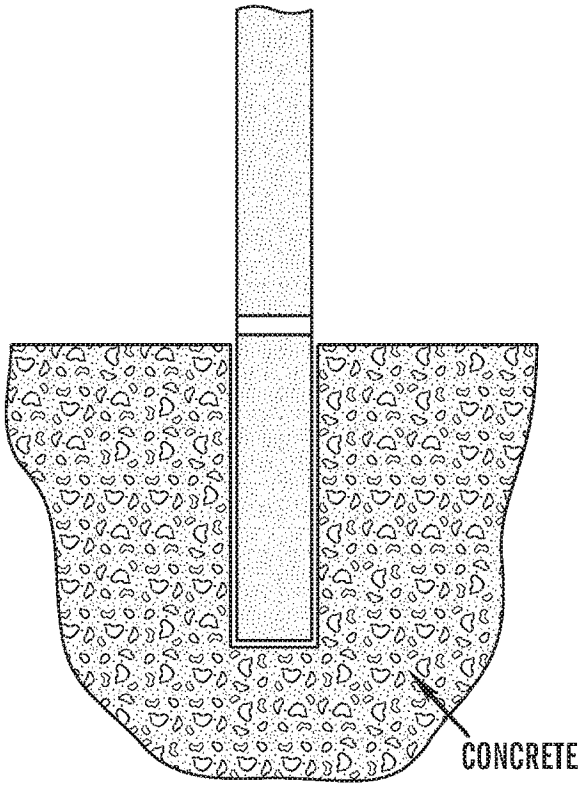
FIG. 9 (Prior Art)
FIG. 9 is a cross-sectional schematic view of a cutting wheel of the prior art during cutting operation.

Moreover, while particular embodiments include the aforementioned segmented grinding wheel, it should be recognized that cutting wheels of conventional rectilinear cross-section, such as shown in FIG. 9, having a diameter D and width w within the aforementioned ranges, may be used in some applications without departing from the scope of the present invention. For example, such a wheel may operate satisfactorily for relatively shallow cutting depths and/or when cutting concrete of relatively high workability, as discussed hereinbelow.

Figure 10:
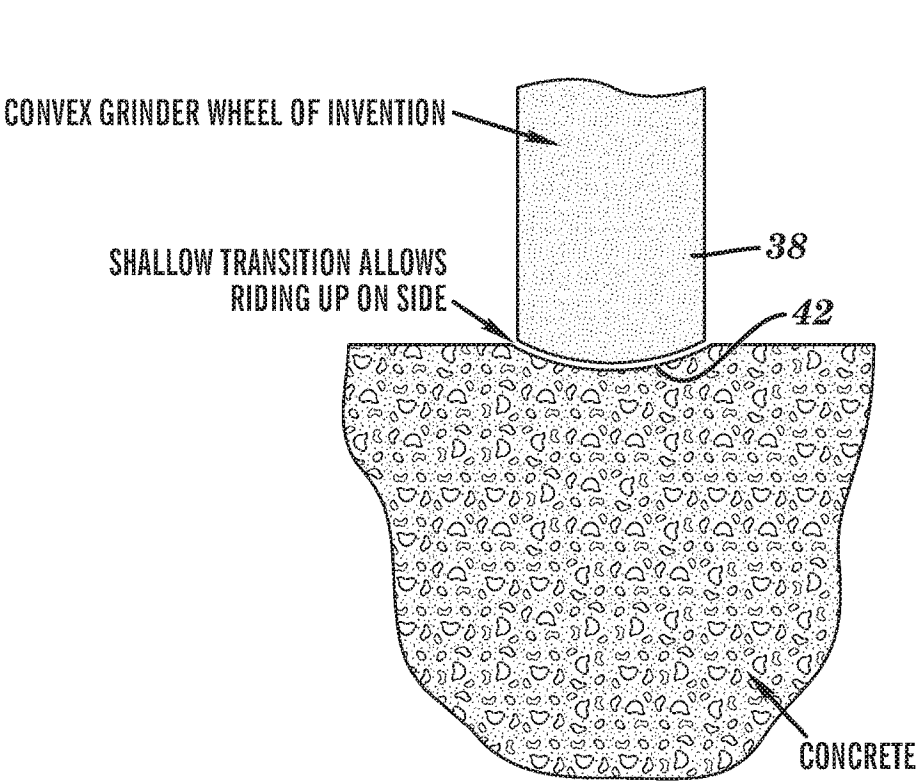
FIG. 10 is a view similar to that of FIG. 9 of the embodiment of FIGS. 1-7.

As best shown in FIGS. 9-11, the convex surfaces of the metallic segments 38 are configured to cut a relatively shallow, correspondingly shaped concave kerf 42 (FIG. 10) in a concrete ground surface. The concave geometry of the kerf 42 enables cutting wheel 26 to follow a non-linear path (FIG. 11), e.g., by steering the wheel 26 in the x-y plane as shown. Those skilled in the art will recognize that the convex/concave geometries of the cutting wheel 26/kerf 42 enable the wheel 26 to cut and/or effectively ride up the side of the kerf as necessary during the steering to avoid the binding that would otherwise occur when cutting with conventional cutting wheels of rectilinear cross-section as shown in FIG. 9. Moreover, as best shown in FIG. 8, the aforementioned placement of cutting wheel 26 between wheels 22 on substantially the same axis of rotation x at a front end portion of the frame 20, and the use of multi-directional wheels 24 at a rear end portion of the frame beneath handle 30, enables the user to steer the cutting wheel 26 by moving the rear end portion laterally, e.g., generally along the x-axis, so that the cutting wheel 26 stays at the center of rotation of the frame about the z-axis. Placing the cutting wheel 26 at the center of rotation in this manner helps minimize lateral forces on wheel 26 while turning.

It is also noted that the resulting concave shape of the kerf 42 may be sized and shaped to resemble the concave shape of a conventional grout or mortar line. This aspect enables the kerf to be colored and/or coated with a thin layer of grout or mortar once cutting is complete, as will be discussed in greater detail hereinbelow.

Turning back to FIGS. 1-5, in particular embodiments, frame 20 includes a ballast receptacle 60 configured to receive a plurality of ballast plates 62 therein to adjust weight of the apparatus, e.g., to provide enough weight to help ensure that cutting wheel 26 cuts at its desired depth. Those skilled in the art will recognize that many factors affect the workability of, the ability to cut, concrete. Some of these factors include: cement content; water content; mix proportions; size of aggregates; shape of aggregates; grading of aggregates; surface texture of aggregates; use of admixtures; and use of supplementary cementitious materials. Thus, concretes of relatively high workability may be cut with relatively low weight on receptacle 60, while a relatively high weight may be needed for less workable concrete.

Thus, the operator adjusts the total weight of the apparatus by adding or removing weights (ballast plates 62) to or from the receptacle 60. Adjusting the total weight in this manner helps ensure that the cutting wheel 26 penetrates the concrete surface to the desired depth, while being limited by a limit stop, according to different levels of workabililty (e.g., compressive strengths) of the various concrete mixes that are encountered, and while minimizing the weight that the operator has to push.

Figure 4:
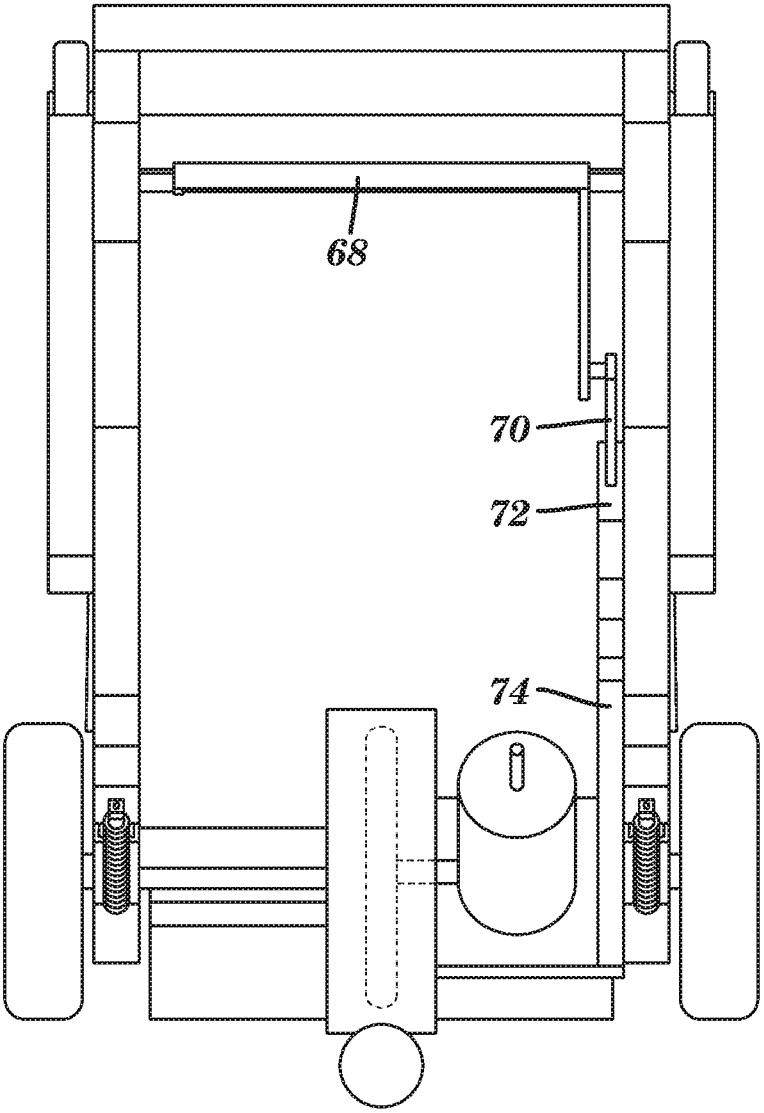
FIG. 4 is plan view of the embodiment of FIGS. 1-3.

In particular embodiments, the cutting wheel 26 is moveable to the desired depth by cutting depth adjuster 66 (FIG. 3) disposed on the frame, and which is configured to alternately move the cutting wheel towards and away from the concrete surface. In the embodiment shown, depth adjuster 66 includes a conventional deadman switch (actuator) 68 (FIG. 3) movable against a spring bias into contact with handle 30 where it may be held by a user during operation. As best shown in FIG. 4, actuator 68 is connected to a linkage 70, cam 72, and spring 74, which biases the cutting wheel 26 out of engagement with the concrete when the actuator 68 is released, while engagement of actuator 68 moves the cutting wheel 26 into engagement with the concrete. The adjustable limit stop prevents the grinding wheel from engaging too deeply into the concrete and thus creates a consistent cut depth. The depth adjuster 66 enables the operator to engage and disengage the grinder as the cut is started or stopped and the machine is moved elsewhere. As discussed, the spring biasing of the adjustor serves as a deadman switch to disengage the grinding wheel 26 from the concrete if the actuator 68 is released by the user. This enhances the safety of the operator and others in case of unforeseen events in which the operator accidentally releases the handle 30.

As best shown in FIG. 5, a dust collector 78, such as a conventional flexible vacuum hose, is communicably coupled to shroud 32 to capture concrete dust generated by the machine. An on/off switch (not shown) for the grinder 34 may be disposed at handle 30.

Referring now to Table I, a method 100 for restoring a concrete ground surface by forming portions resembling natural stone, pavers or flagstone is described.

TABLE I

| | |
|---|---|
| 102 | providing 102 the apparatus shown and described with respect to FIGS. 1-11 |
| 104 | engaging 104 the handle 30 and steering the apparatus to a desired location |
| 106 | Optionally marking the non-linear path |
| 108 | visually aligning the shroud and cutting wheel with the non-linear path |
| 109 | Optionally aligning along a clear line of sight from handle, through the frame, to the shroud |
| 110 | Actuating cutting wheel |
| 112 | Actuating depth adjuster 66 to engage cutting wheel with concrete surface |
| 114 | Guiding cutting wheel along the non-linear path |
| 116 | Once cutting is complete, releasing depth adjuster to lift the cutting wheel out of the kerf. |

The method 100 includes providing 102 the apparatus shown and described with respect to FIGS. 1-11, engaging 104 the handle 30 and steering the apparatus to a desired location on the concrete ground surface, i.e., to a point on a non-linear path on the concrete ground surface. The non-linear path may be optionally marked on the ground at 106, e.g., using chalk or the like, or may be created by the user extemporaneously while steering the apparatus.

While engaging the handle, the user visually aligns, at 108, the shroud 32 and cutting wheel 26, with the non-linear path. Optionally, the visually aligning 108 includes looking 109 along a clear line of sight s extending from handle 30 through the frame 20 to the shroud 32. The cutting wheel 26 is then actuated 110 with motor 34. At 112, the user engages actuator 68 of the depth adjuster 66 to engage the rotating cutting wheel 26 with the concrete ground surface to cut a kerf 42. At 114, the user walks behind and steers the apparatus to guide the cutting wheel along the non-linear path, so that the kerf extends along the non-linear path. The orientation of the grinding wheel between the fixed direction front wheels as well as the multi-directional rear wheels, keep the grinding wheel in the center of z-axis rotation. The convex shape of the grinding wheel allows for smooth turns along the cut path as the operator turns the machine left or right, without binding in the kerf, e.g., by effectively permitting the cutting wheel to ride up and/or into the side walls of the kerf while turning. Once cutting is complete, the operator releases the actuator 68 at 116 so that the spring bias of depth adjuster 66 lifts the cutting wheel 26 out of the kerf.

Referring now to Table II, additional option aspects of method 100 include placing one or more ballast plates 62 on a ballast receptacle 60 of the frame at 122, prior to said actuating depth adjuster 112. At 126, grout or mortar is optionally applied to the kerf, and at 128, color in the form of paint, stain and/or dye is applied to the concrete ground surface and/or to the grout or mortar. It should be recognized that the term 'concrete ground surface' refers to the concrete surface forming the 'ground' upon which users walk with the walk-behind apparatus 10. The application of color to the concrete ground surface at 128 may thus help make the portions of the concrete bordered by the kerfs resemble flag stones and the like. At 130, the color application 128 includes applying a base color substantially uniformly to the concrete ground surface including the grout or mortar, and then selectively applying a secondary color to portions, e.g., peaks, of the concrete surface texture, in an irregular and/or selective manner, to produce a color distribution resembling natural stone pavers and flagstones.

TABLE II

| | |
|---|---|
| 122 | Placing ballast plates on ballast receptacle |
| 126 | Applying grout or mortar to the kerf |
| 128 | Applying color to the concrete ground surface and/or to the grout or mortar |
| 130 | Applying a base color to the concrete ground surface, and selectively applying a secondary color to portions of the concrete surface texture in an irregular and/or selective manner |

Having described various embodiments of devices and methods for cutting nonlinear patterns into concrete surfaces, the following alternative embodiments are provided for cutting linear patterns, e.g., to replicate conventional rectilinear tile installations as often used indoors, but which may also be used in outdoor applications.

These alternate embodiments enable a user to cut line patterns into concrete that are similar to those found in ceramic porcelain, natural floor tile or installations of tiles made from similar materials: namely, patterns formed by a series of straight lines extending along two orthogonal directions, to form rectangular (e.g., square) shapes that repeat to emulate typical floor tile patterns.

These embodiments provide for:

a. Repeatedly cutting a first set of straight, parallel lines in a first direction, the parallel lines being spaced at substantially the same distance from one another;
b. Repeatedly cutting a second set of straight, parallel lines in a second direction that is orthogonal to the first direction;
c. Providing convenient portability for expeditiously treating floor areas greater that the area spanned by the apparatus itself; and
d. Providing for expeditious setup and take-down on job sites.

As discussed hereinabove, concrete is widely used as a material for flooring, both indoors and outdoors, e.g., by pouring into a form constructed of wood or other suitable material. The resulting concrete slabs form the basis of flooring in residential and commercial buildings on ground level and additional levels above the ground floor. Historically, there have been many ways to cover the concrete slabs to create useful and attractive flooring for the inhabitants or users. These options include but are not limited to: carpet glued onto the slab, vinyl-composite tile glued onto the slab, hardwood flooring installed over the slab, paint applied over the slab, ceramic or natural or other tile installed over the slab, etc. Each of these flooring options has certain advantages and disadvantages.

One additional way of creating a useful and attractive flooring option using concrete slabs is so-called Concrete Polishing. In concrete polishing, the surface of the slab is ground and polished in various steps to create a smooth surface. These steps include—but are not limited to—the application of a sealer that closes the pores and helps to prevent concrete dusting, among other benefits.

The present inventor has recognized that one additional way to create a useful and attractive flooring using concrete slabs is to cut shapes into the slab that resemble grout lines, in the dimensions and patterns one would commonly associate with ceramic or similar floor tiles. In combination with additional steps/techniques, including the installation of grout within the cuts, one can create the look and feel of ceramic or natural stone tiles in concrete slabs without the material cost and installation time associated with such conventional tile installations. Prior to development of the embodiments shown and described hereinbelow, the present inventor has been unable to locate a portable machine that would allow a user to repeatedly cut a first set of straight, parallel lines in a first direction, and repeatedly cut a second set of straight, parallel lines in a second direction that is orthogonal to the first direction, with sufficient accuracy as one would find in a ceramic or natural stone tile installation, in order to resemble ceramic or natural stone tiles.

The present inventor recognized that one potential approach would be to try and adapt an otherwise conventional CNC moving table and XY-gantry, to provide the desired cuts. The inventor recognized, however, that conventional CNC XY-gantries have significant shortcomings in several key areas. First, they are not mobile. Once assembled, they are not meant to be taken apart and moved frequently. It is difficult—if not virtually impossible—to change their size, e.g., to accommodate different size jobs/job sites. In addition, by design, conventional XY-gantries carry their payload on a horizontally straight and level path which does not conform to the imperfect flatness of a typical poured concrete surface. Still further, conventional XY gantries use linear bearings that require a tightly toleranced setup of the X and Y bars to function properly. For this reason, they would not tolerate, for example, set up at a less-than-precision 90 degree angle, such as may be expected at a job site, potentially leading to cocking of the bearing and a locked-up mechanism. For these reasons, such conventional XY gantries are not used in the embodiments hereof.

The inventor also recognized that suitable equipment to accomplish straight, parallel and perpendicular cuts on concrete surfaces in a production environment, would need to be highly mobile. For example, the equipment would need to fit easily into a conventional 16 ft or 20 ft cargo trailer along with additional unrelated equipment. It would also need to be easily carried to and from the jobsite. It would need to be set up and taken down on the jobsite with minimal effort, and also during multiple moves on the jobsite to cover an entire work area. It would need to be able to be operated by untrained or lightly trained personnel, and would need to be able to cover areas of different sizes and odd shapes, e.g., large rooms, small rooms, large rooms with small alcoves, relatively narrow hallways and so on. The embodiments shown and described hereinbelow provide for such desired mobility, while also being tolerant of dust and physical abuse often found on a typical job site.

Figure 15:
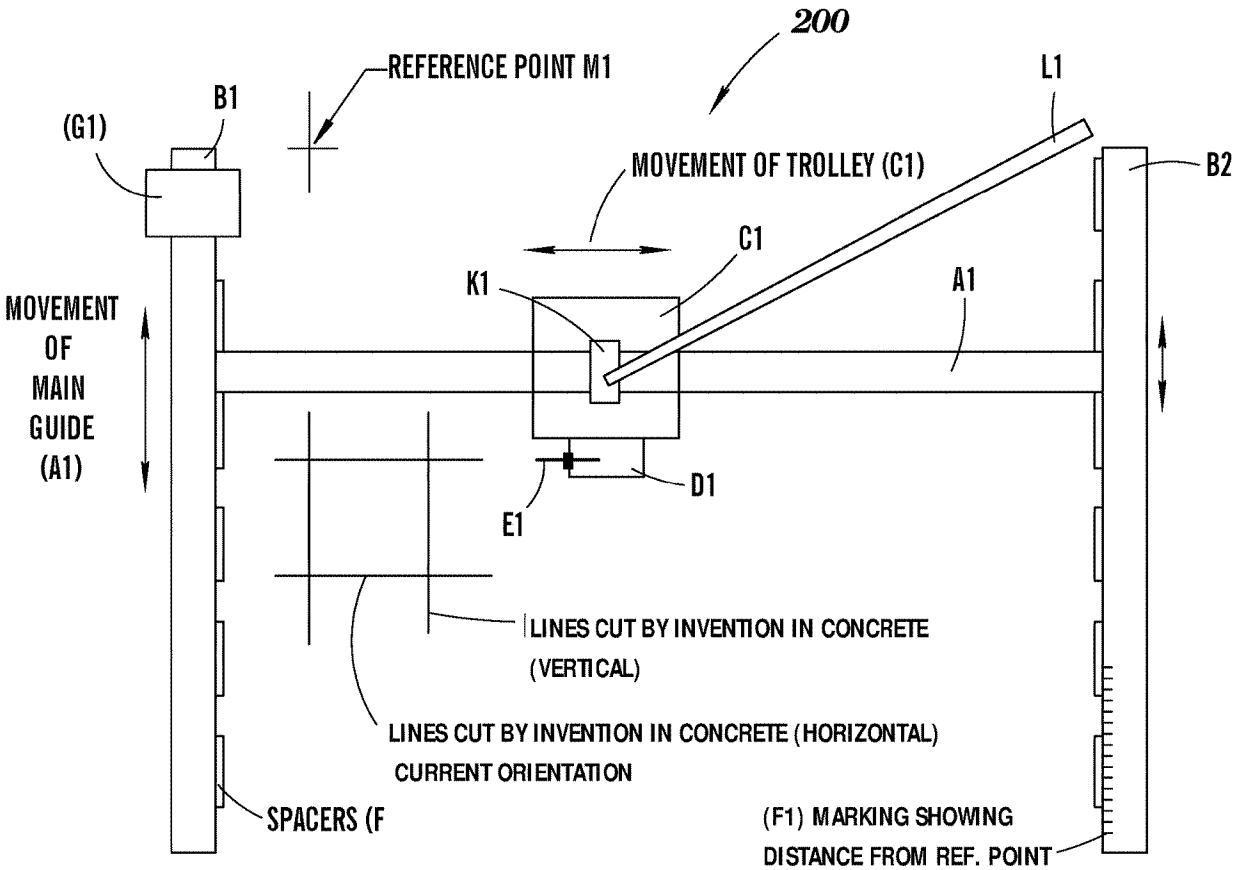
FIG. 15 is a plan schematic view of an alternate embodiment of the present invention.

Referring to FIG. 15, a top plan view of an embodiment of the linear cutter 200 of the present invention shows the general orientation of its main components: track (A1), two pieces perpendicular side bars (B1, B2), main tool trolley (C1), commercially available main cutting tool (D1), a commercially available cutting blade (E1), a hinge (K1) that affixes a push-handle (L1) to (C1) in a flexible or rigid manner.

The main tool trolley (C1) travels along the track (A1), as propelled manually (operator pushes with handle L1), or by machine (motor driven). The main trolley is made by sufficiently strong and stiff material, sufficiently machined to tolerances that allow for straightness as required in this application. As the trolley travels along the path determined by track (A1) and—if cutting tool (D1) is powered on, the cutting blade (E1) cuts a line into the concrete.

Figure 16:
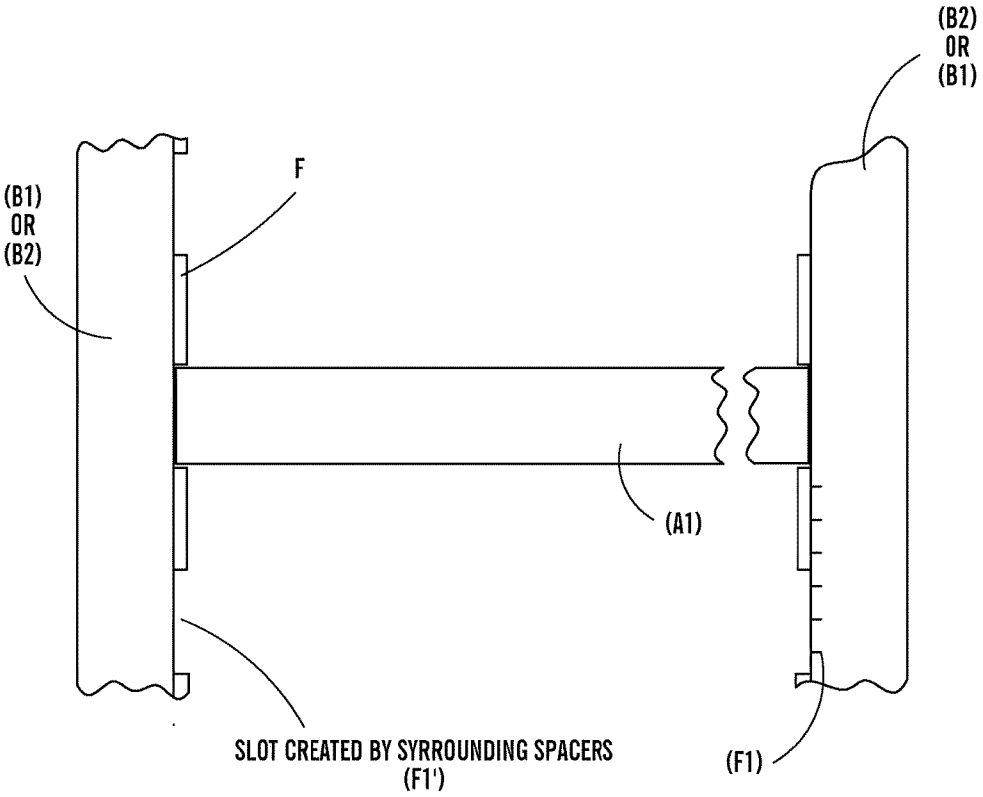
FIG. 16 is a view similar to that of FIG. 15, of components of the alternate embodiment on an enlarged scale.

The main guide (A1) is temporarily affixable to the perpendicular side bars (B1 and B2). B1 and B2 may include demarcations F1 showing distances along the lengths of side bars B1 and B2. These demarcations F1 allow track A1 to be easily placed and secured at various spaced locations along the length of, and extending orthogonally to, side bars B1 and B2. In particular embodiments, the markings can be substituted or complimented by slots F1' sized and shaped to receive ends of the track A1 therein, or by similarly suitable mechanical fixtures that allow the affixation of the track A1 to bars B1 and B2. For example, as shown in FIG. 16, a series of slots F1' may be provided at spaced locations along the lengths of bars B1 and B2 by (a) attaching spacers F2 to bars B1 and B2, or by (b) machining, etc.

Figure 17:
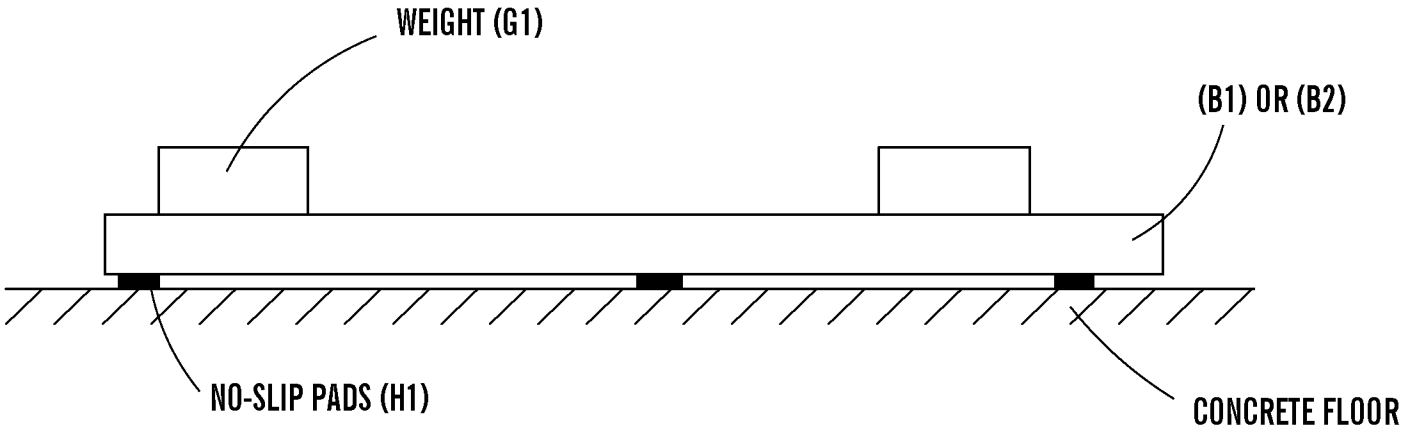
FIG. 17 is an elevational schematic view of components of the embodiments of FIGS. 15 and 16.
Figure 18:
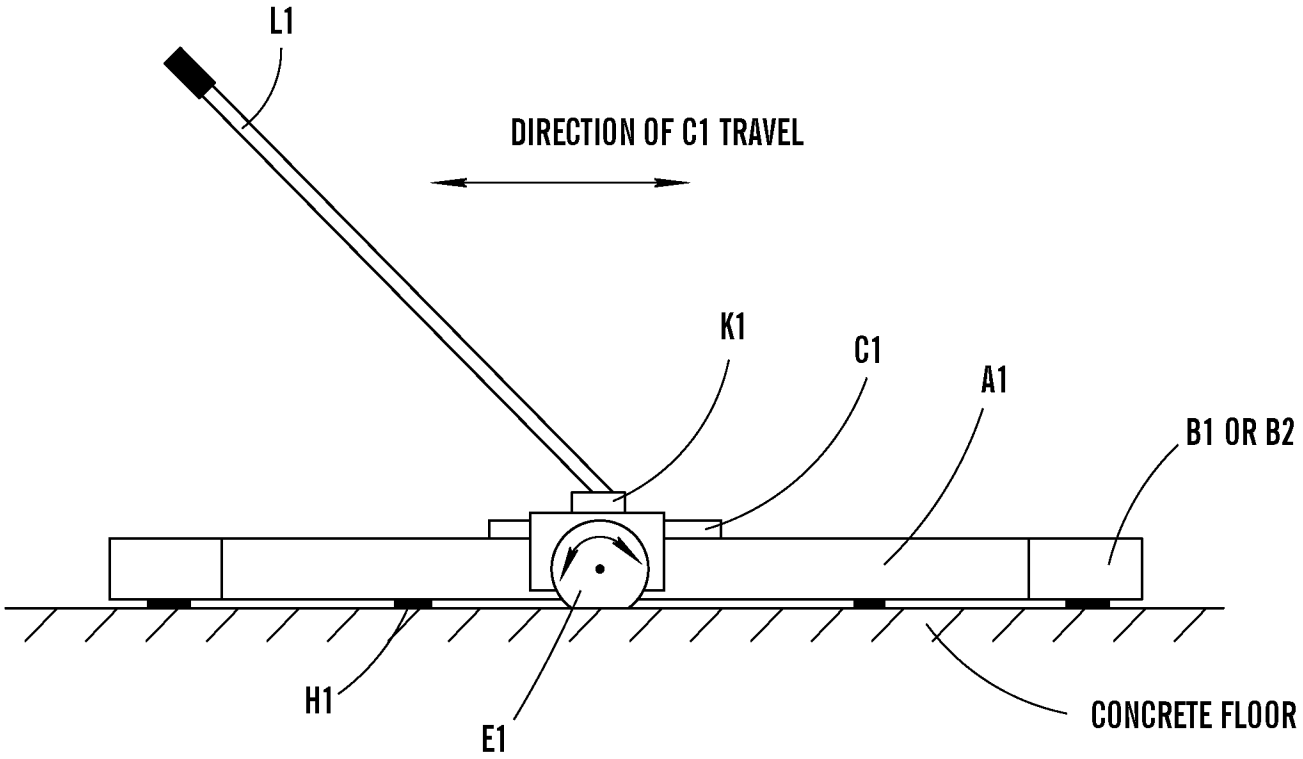
FIG. 18 is an elevational schematic view of additional components of the embodiments of FIGS. 15-17.

Referring now to FIG. 17, A1, B1 and B2 may be affixable to the concrete floor by one or more ways, including but not limited to fixtures that allow for mounting onto a bolt that was previously drilled into the floor, gluing the bars B1, B2 onto the floor with a suitable glue, or attaching the bars by means of no-slip pads, adhesive tape, or hook and loop fasteners (e.g., VELCRO®, Velcro Group Corporation, Boston, Mass.), as shown at H1 on the floor-facing surfaces of A1, B1 and B2. While these approaches help prevent the accidental sideways movement of A1, B1 and or B2, to further reduce the chances of A1, B1 and B2 inadvertently moving sideways, weights (G1) may be added to the top side of A1, B1 and B2 as shown in FIG. 17, e.g., within suitably sized and shaped ballast receptacles such as shown hereinabove at 60.

Figure 21:
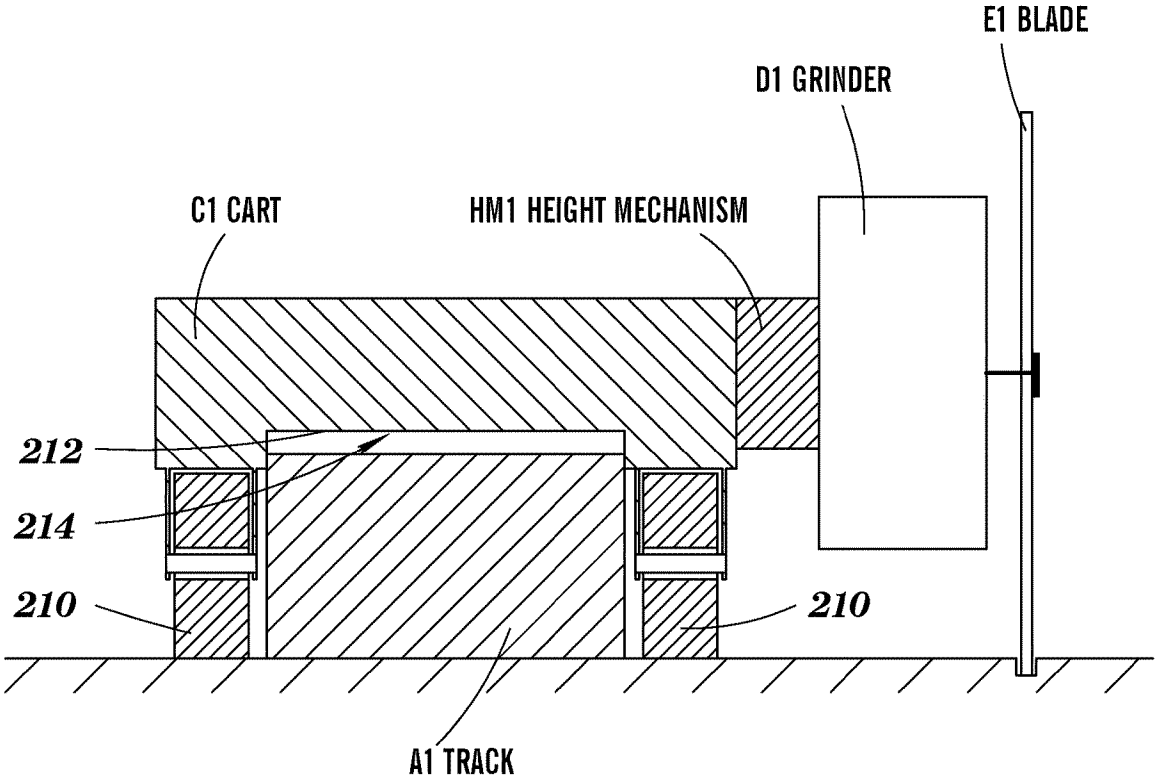
FIG. 21 is a schematic front view of components of the embodiments of FIGS. 15-18.

To operate the apparatus, the operator may position A1, B1 and B2 on the concrete floor as shown in FIG. 15 and so that it aligns with the desired future pattern on the floor. This can be done with or without the help of a Reference Point M1. Bars B1 and B2 are positioned parallel to each other and at a distance from each other that corresponds to the length of A1. A1 is inserted perpendicularly between bars B1 and B2 and affixed to each temporarily, e.g., using slots F1' (FIG. 16). The operator places trolley C1 into slidable engagement with track A1, as will be discussed in greater detail hereinbelow, to permit the trolley to move along the length of track A1. The operator powers on cutting tool D1 and engages cutting blade E1 with the concrete floor as shown in FIG. 21. It should be noted that cutting blade E1 may include cutting wheel 26 as shown and described hereinabove, with or without the aforementioned convex cross-section. For example, in particular embodiments, cutting blade E1 may include a rectilinear cross-section, such as shown in FIG. 9. It should also be noted that in many linear cutting applications, cutting wheel 26 has smaller diameter and width than used for the outdoor applications shown and described hereinabove. For example, various embodiments cutting wheel 26 has a diameter D in a range of from about 2 inches to about 8 inches, with a cutting portion having a width w in a direction parallel to said cutting wheel axis of rotation within a range of from about ⅛ inches to about ⅜ inches. Particular linear cutting applications may use a cutting wheel 26 having a diameter D in a range of from about 4 inches to about 5 inches, with a width w within a range of from about ⅛ inch to about ¼ inch.

Using handle L1, the operator pushes trolley C1 along track A1 and thus cuts a line into the concrete. Note that optionally, the operator may intermittently raise and lower cutting tool D1 and blade E1 to respectively disengage and engage E1 with the concrete, to form discontinuous patterns, such as the offset rectangular patterns shown in FIG. 19B.

Figure 19B:
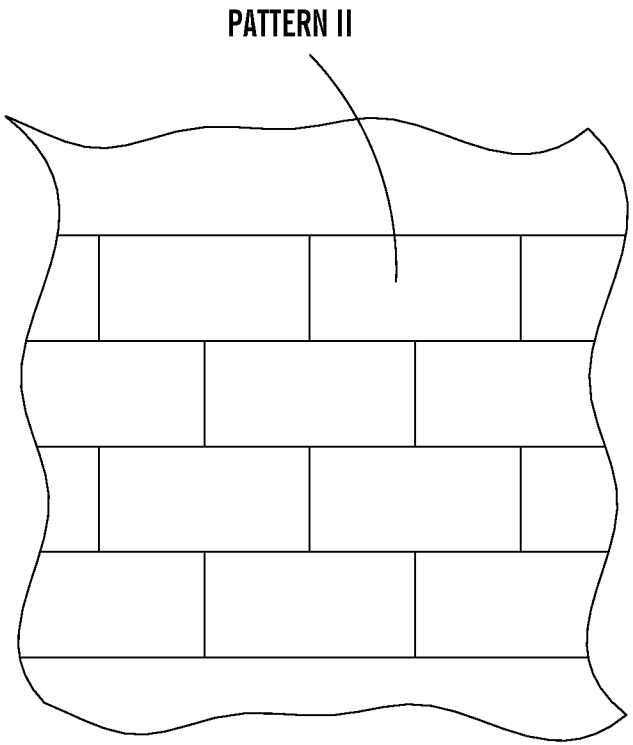
FIG. 19B is a plan view of an alternate pattern of kerfs cut by the embodiments of FIGS. 15-18.
Figure 19A:
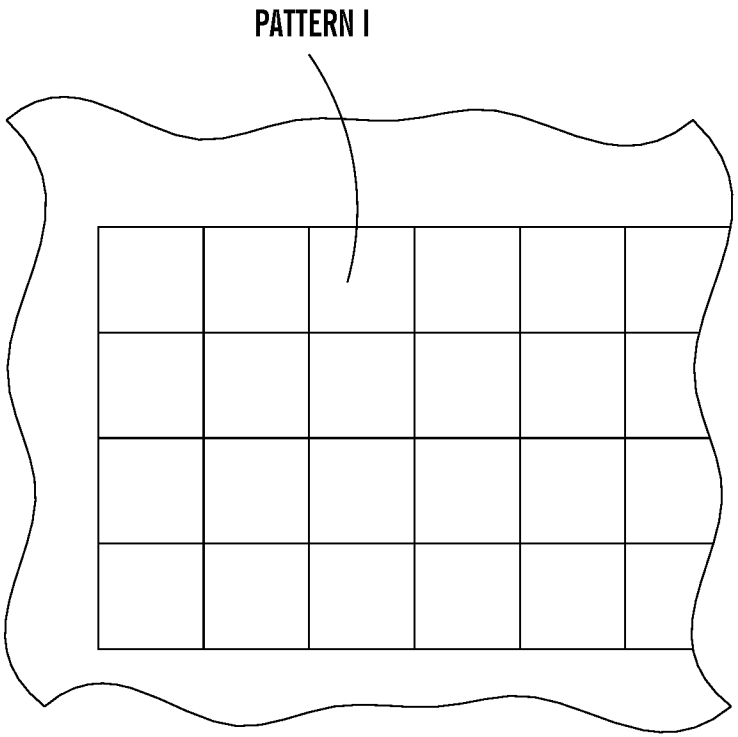
FIG. 19A is a plan view of a pattern of kerfs cut by the embodiments of FIGS. 15-18.

Once trolley C1 has reached the end of track A1, the operator powers off tool D1, removes trolley C1 from track A1, and using demarcations/slots F1, F1', moves track A1 into a predetermined position between bars B1, B2 parallel to and spaced from the previously cut line. The operator then places trolley C1 onto track A1 and repeats the above steps until a desired number of parallel cuts, e.g., either continuous or discontinuous, in a first direction have been made. When track A1 has reached the distal end of bars B1 and B2, the operator may rotate the entire linear cutter 200 by a desired increment (e.g., ninety degrees in many applications) and repeat the aforementioned process to make a desired number of parallel cuts in a second direction. As mentioned, continuous cuts in first and second directions at 90 degree angles to one another may be used to produce a pattern of squares as shown in FIG. 19A, while discontinuous cuts in one direction may be used to produce a pattern of offset rectangles as shown in FIG. 19B. The cutter 200 may also be moved to adjacent portions of the concrete floor to extend the pattern to floor areas larger than the area covered by the cutter itself.

Figure 20:
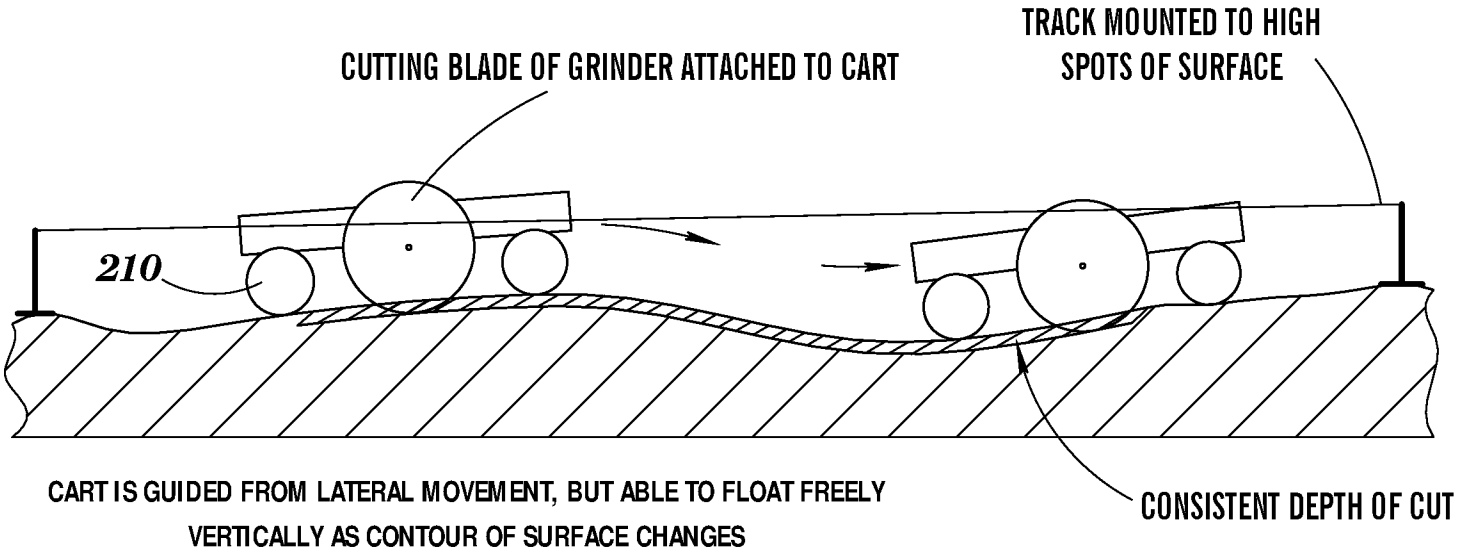
FIG. 20 is an elevational schematic view of components of the embodiments of FIGS. 15-18 illustrating movement during operation thereof.
Figure 22:
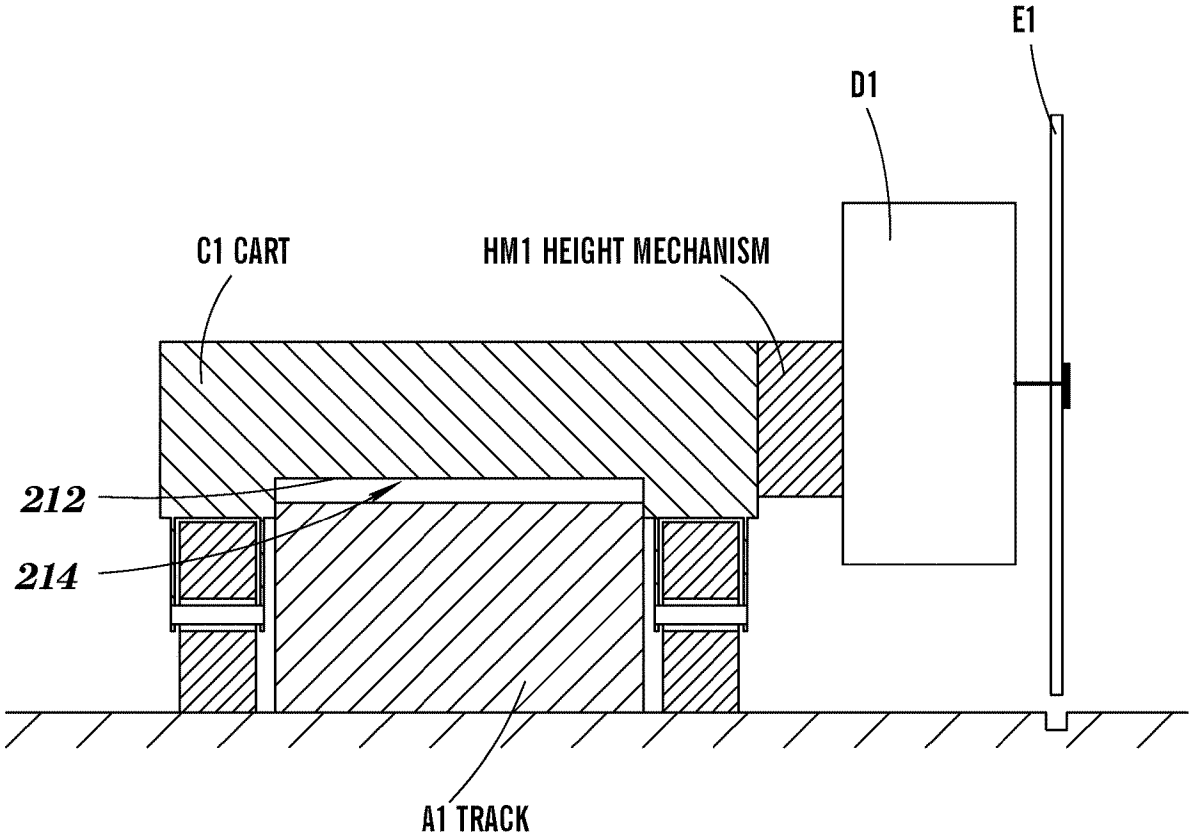
FIG. 22 is a schematic front view of the components of FIG. 21 in an alternate position.

Turning now to FIGS. 20-22, particular variations of the above-described embodiments provide for mobility, as discussed hereinabove, while also providing the ability to cut evenly into non-flat surfaces. Indeed, these embodiments are able to cut trenches of consistent depth into a concrete floor that has less-than-perfect flatness (i.e., one that is wavy). In this regard, it should be noted that although conventional poured-in-place concrete floors appear flat to the naked eye, they typically have relatively large variations in height even over relatively short horizontal spans. In the concrete industry, "'waviness" of the surface is referred to as "flatness", which may be measured in several ways and is often expressed in terms of a so-called "FF" number. Depending on the method, tools and materials used during the original installation of the concrete slab, the concrete surface may have a height variation of, for example, ¼ inch or more over a horizontal span of just 4 feet. As shown in FIG. 20, this variation looks like a valley surrounded by hills or vice versa. For a realistic resemblance of real tiles, in particular applications, the cuts (kerfs) which form grout lines should be of a consistent depth, which is typically relatively shallow (e.g., 1/16 inch or less). In many applications, a variation of ¼ inch or more in the cut depth would not only be an unconvincing representation of a grout line to the viewer, but it may also be detrimental to the cutting process, as constantly varying the depth of cut would put changing forces on the blade and grinder etc., which would tend to change the tool speed and prematurely wear the equipment.

In light of the foregoing, particular embodiments of the present invention include the cutter 200 as shown and described hereinabove, in which bars B1 and B2, and track A1 are fabricated from a lightweight and structurally rigid and tough material such as aluminum, all having the substantially the same cross section of, as a non-limiting example, approximately 4 inches wide×2 inches high (rectangle) and between 4 ft and 20 ft long, e.g., in increments of 4 ft. The pieces that make up the sidebar set are chosen so that they provide flexibility to create different assembly sizes on the job site, as needed for areas of different sizes and shapes, as typical in flooring installations. The side bars B1 and B2 may be stored and transported to the job site in a trailer, truck, etc. The maximum length of the sidebars and tracks is limited by the length of the trailer, truck etc. If needed, the operators can extend the length of a sidebar by attaching another sidebar with special fittings. The materials and cross section choice of the side bars may be selected to provide light weight and resistance to damage when bumped, dropped, etc. In addition, these components should be sufficiently stiff to facilitate being carried by two people without excessively flexing or bending. In particular embodiments, aluminum has been found to be a satisfactory material from which to fabricate these components.

No-slip pads and/or weights may be used as shown and described hereinabove. Moreover, in particular embodiments, spacers are attached to the vertical part of the long side of the sidebars in the following manner. Depending on the required "tile" size for the installation (e.g. 12 inches), the spacers have a length that equals the "tile" width (12 inches) minus the width of the main track (e.g., 4 inches'). This allows the main track to be inserted between and perpendicular to side bars B1, B2, and to be removably held in place for one cut along the main track A1. An exemplary tool cart C1 is approximately 20 inches long, 12 inches wide and 6 inches high. The skilled artisan should recognize that spacers of substantially any configurations may be used, including those formed integrally with, or separate from, bars B1 and B2, without departing from the scope of the present invention.

As shown, in particular embodiments, the cart C1 includes a plurality (e.g., four) support wheels 210. In one particular non-limiting example consistent the dimensions included above, wheels 210 may be about 2 inches in diameter, attached by casters. As shown in FIG. 20, these wheels remain in contact with the floor as the cart moves along the track A1. As shown in FIGS. 21 and 22, cart C1 has on its underside an upside-down U-shaped receptacle 212 sized and shaped to slidably receive track A1 therein. As also shown, the receptacle 212 is sized and shaped to be in slidable surface-to-surface engagement with opposite sides of track A1, while leaving a gap 214 that permits the cart C1 to move vertically as it follows the contours of the concrete while traveling the length of the track A1. (It should be recognized that the aforementioned vertical freedom of movement may be accomplished using any number of alternative approaches that would be apparent to those skilled in the art in light of the instant disclosure.) In the particular embodiments shown, attached to the side of the cart C1 is cutting tool D1 in the form of a commercially available 4½ inch handheld angle grinder, e.g., mounted by use of the available female mounting threads provided with most conventional angle grinders. As also shown, the tool D1 is attached to the cart C1in such a way that the plane of the grinding wheel E1, i.e., the plane in which the grinding wheel/blade E1 rotates during use, is parallel to the length of the main track A1. In addition, a commercially available dust shroud (not shown) may be disposed over the blade E1 and connected to a dust remover/vacuum. The use of a commercially available grinder allows for relatively low cost and simple and inexpensive replacement should one fail in the field. As also shown, cart C1 includes a depth/height adjustment mechanism HM1, e.g., in the form of a manually or electrically actuated linear actuator or the like, which is configured to move the tool D1 and blade E1 into and out of engagement with the concrete as respectively shown in FIGS. 21 and 22.

These embodiments may be operated substantially as shown and described hereinabove with respect to FIGS. 15-19B.

Figure 23:
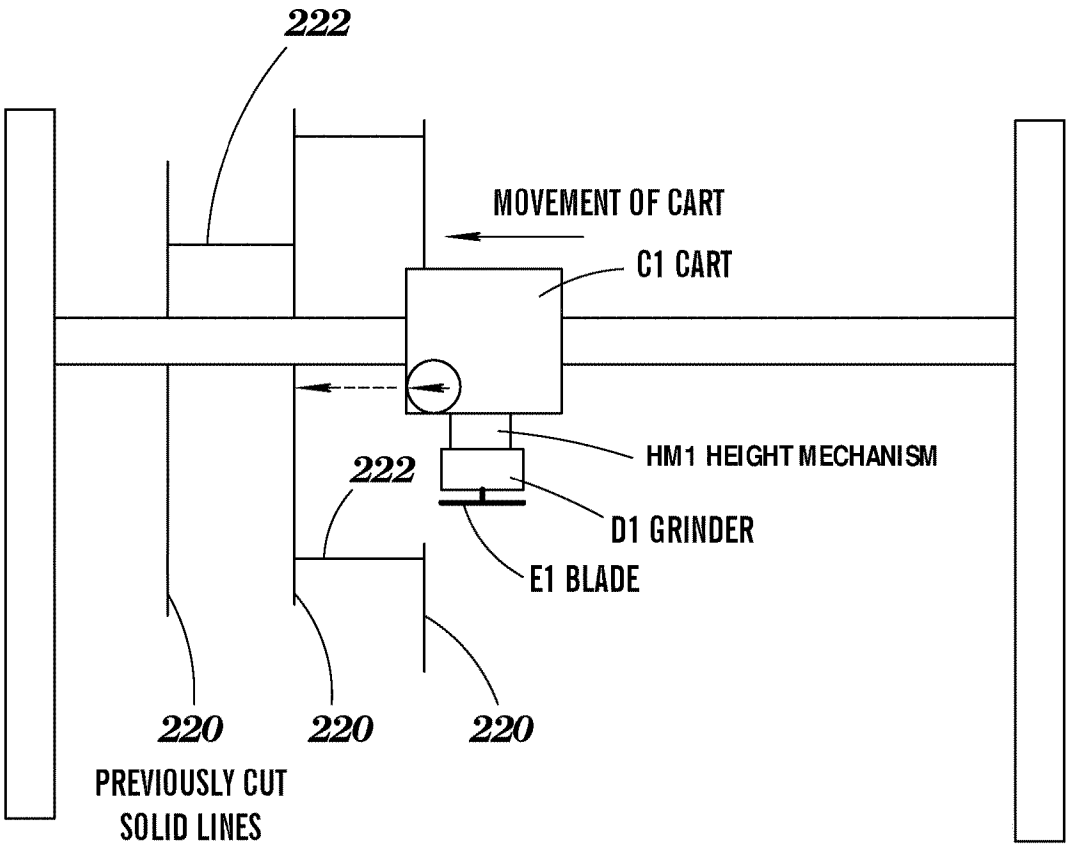
FIG. 23 is a schematic plan view of a variation of the embodiments of FIGS. 15-18.

Turning now to FIG. 23, the present inventor has recognized that a significant portion of conventional floor tile installations are of a staggered or offset pattern, such as the rectangular pattern shown in FIG. 19B. This staggered pattern is also referred to as a running bond pattern or brick layout pattern. In this pattern, the tiles may be square or rectangular, with edges of adjacent tiles lined up to form a continuous grout line in one direction (line 220), while the edges in the orthogonal direction are offset to form an interrupted/discontinuous grout line 222. The resulting discontinuous line is effectively a dashed line with equal length dashes and interruptions. The offset can be at 50% of the tile length, such as shown in FIG. 19B, or substantially any desired percentage of the tile length.

Particular embodiments of the present invention are configured to facilitate accurately cutting dashed lines in order to emulate the aforementioned staggered tile patterns.

One way to accomplish the cutting of dashed lines using embodiments hereof is to:

1) Align the track A1 and cart C1 along the desired dashed line.
2) Lower the cutting blade and grinder, e.g., using HM1, to engage with the concrete (FIG. 21).
3) Cut the desired length of concrete to represent the first tile edge. The length of the cut equals the length of one simulated tile.
4) Raise the cutting blade and grinder, e.g., using HM1, to disengage from the concrete (FIG. 22) for the next tile section.

The length of the interruption/non-cut equals the length of one simulated tile.

5) Go back to step 3 and repeat until the cart has traversed the lesser of the length of track A1 or the extent of the area to be patterned.

It should be recognized that with the above process, the accuracy of the raising and lowering of the blade/grinder plays a role in the authentic look of the result. A cut that is slightly too long (over-cutting beyond the transverse cut line) or too short (under-cutting by not reaching the transverse cut line) would make the final installation look inauthentic. And, with typical grout lines having a width of only about ⅛ inch to ¼ inch, the transversely cut lines simply do not provide sufficient tolerance for consistently and efficiently raising and lowering the apparatus by hand without over- or under-cutting. This issue is further complicated by the fact that the cutting blade E1 is round and rotates in a plane parallel to the cut direction/kerf, which means that a sharp beginning and end of the cut is difficult to achieve manually.

An aspect of particular embodiments of the invention is therefore the semi- or fully-automated raising and lowering of the blade E1 as it traverses the track A1. As shown in FIGS. 21 and 22, Height Mechanism HM1 may be used to raise and lower the grinder D1/blade E1 in response to a signal from a suitable sensor.

This can be achieved in the following ways.

a) Semi automated. A pattern (not shown) in the form of alternating raised lengths representing the width (or length) of a tile may be attached to the track A1. There is a gap or lowered region between each raised length that is also equal to a tile width (or length). In addition, there is an indicator (not shown) mounted on the cart C1. This indicator registers with the pattern as the cart C1 moves along the track A1. As the indicator moves along the pattern, it registers against the upwards and downwards flanks of the pattern P1. HM1 on cart C1 moves the grinder/blade upwards (to disengage the concrete) each time the indicator reaches an upwards flank. When the indicator reaches a downward flank, the grinder/blade moves downward, engaging the concrete. And so forth.

b) Automated. Track A1 is aligned with the floor to extend orthogonally to previously cut continuous lines 220. Mounted on the cart C1 is an Optical Object Detector (front sensor) OOD1 device which continuously scans the area in front of the cart C1. (It should be noted that where optical sensors are referenced herein, those skilled in the art will recognize that substantially any type of sensor, including both contact and non-contact sensors such as limit switches and proximity detectors may be used in particular applications.) An exemplary OOD1 suitable for use in embodiments hereof is the OpenMV Cam M7 low power, microcontroller board camera (available from Seeed Technology Col, Ltd., Guangdong, China) which is programmable in high level Python scripts to implement machine vision.

As the cart is moved along the track, the object detector OOD1 recognizes the approaching continuous cut line 220. At one line 220, the OOD1 triggers the HM1 to raise the grinder/blade to disengage from the concrete as shown in FIG. 22. As the cart continues to move long the track, and as the OOD1 recognizes the next cut line 220, the HM1 lowers the grinder/blade into engagement with the concrete as shown in FIG. 21 to create a cut line 222. The cycle continues until the cart has reached the end of the desired space. In addition to raising and lowering the grinder/blade, the OOD1 may be configured to turn the grinder on and off as it is engaged and disengaged, respectively, with the concrete, for additional safety.

Figure 24:
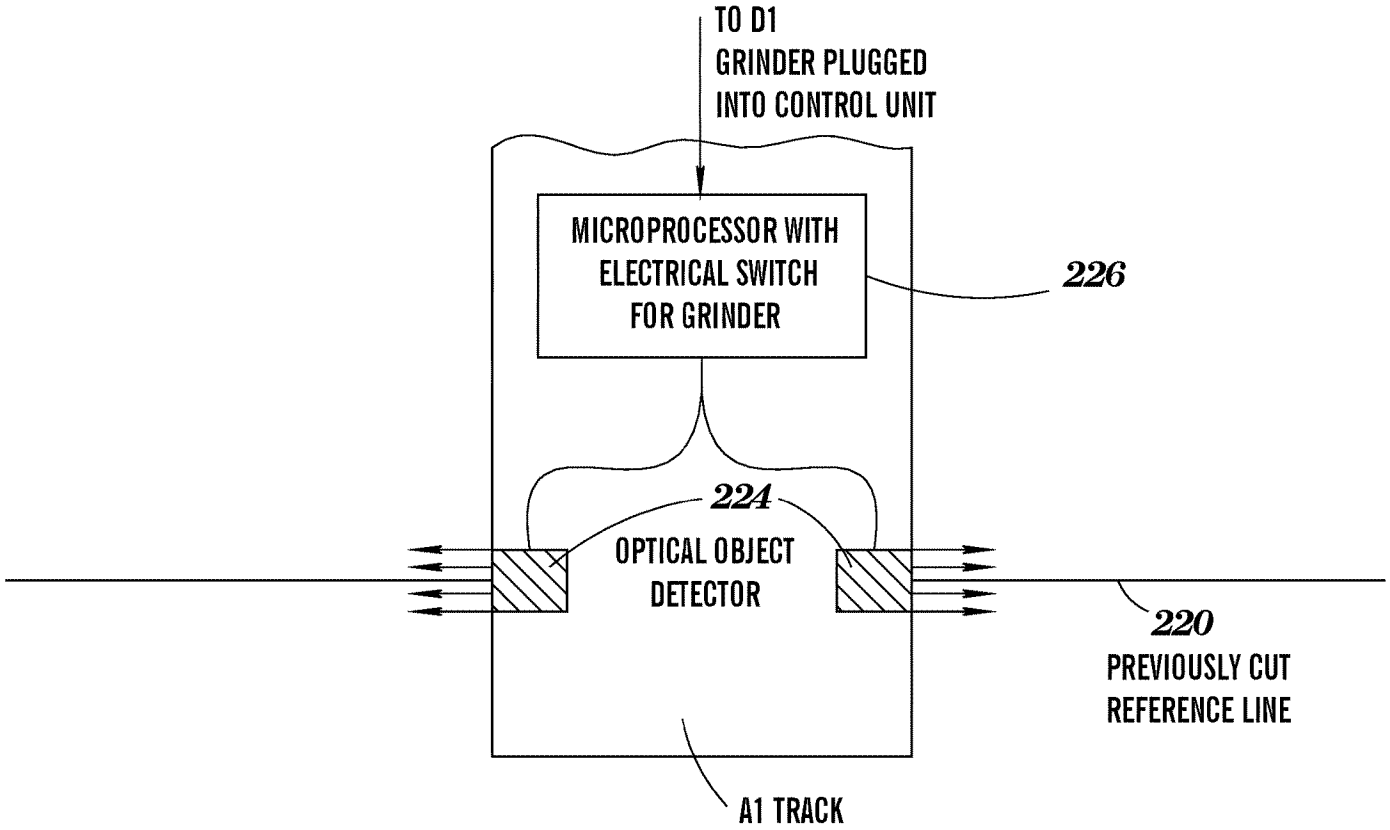
FIG. 24 is a schematic plan view on an enlarged scale of components of another variation of the embodiments of FIGS. 15-18.
Figure 25:
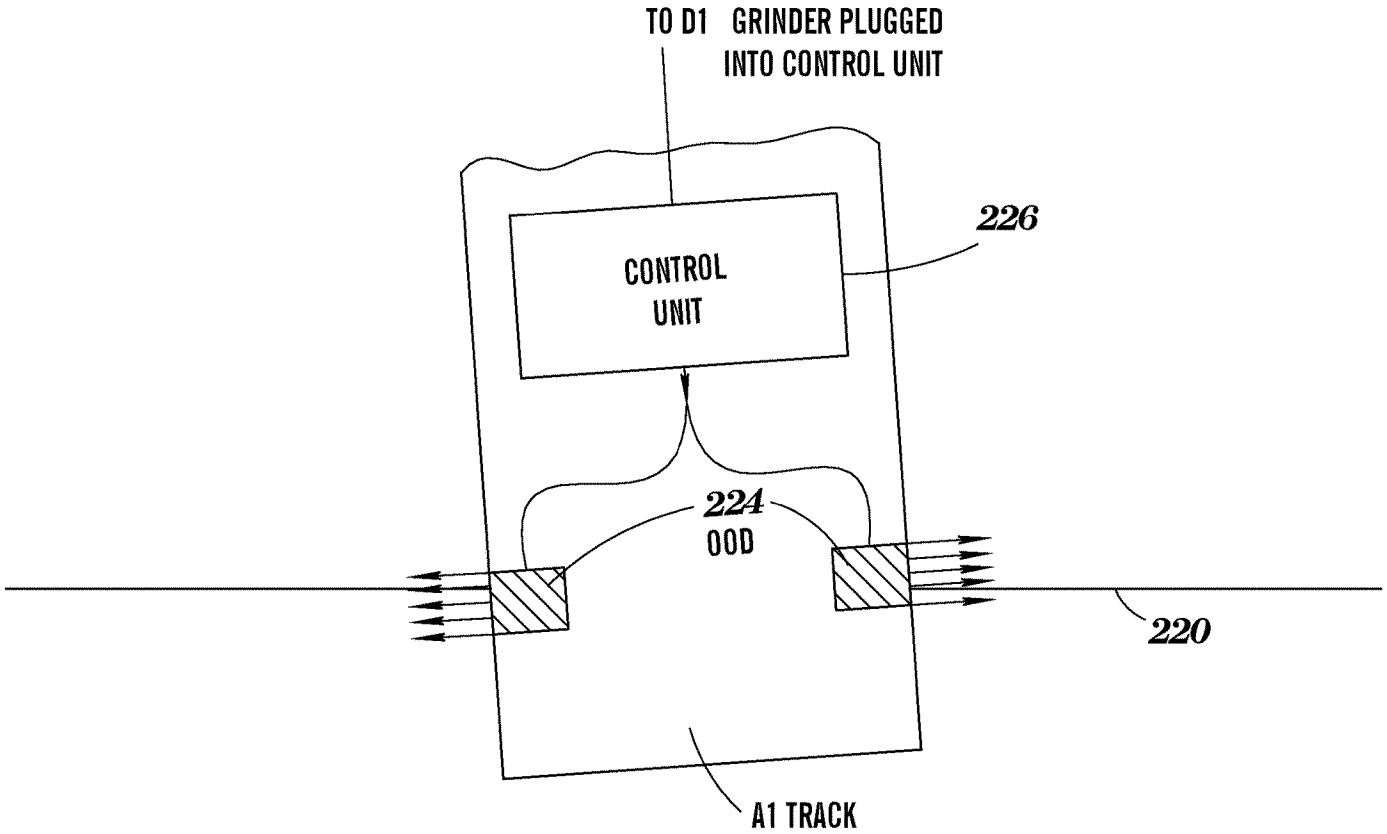
FIG. 25 is a view similar to that of FIG. 24, showing movement.

Turning now to FIGS. 24-25, additional variations of the foregoing embodiments are configured to help ensure proper orthogonal alignment of cut lines 222 relative to cut lines 220 (FIG. 23). An aspect of these variations was the realization of both the importance, and the difficulty in the field, of properly aligning the track A1 prior to cutting the concrete, even with the aforementioned demarcations/spacers F1/F1'. The inventor recognized that when making tens or hundreds of cuts a day in the field, with each cut involving moving and re-aligning track A1, distractions and time pressure take a toll on users. Moreover, incorrect cuts are virtually impossible to completely fix. Various embodiments address this issue by helping to eliminate human error associated with aligning the track A1.

Indeed, the accurate alignment of the apparatus with the desired cut pattern and with previously cut lines is used to achieve an authentic tile look. Since most tiles are square or rectangular, any deviation of the cut lines 220, 222 (FIG. 23) from a 90 degree angle relative to one another would break the tile look and be unacceptable in most applications. (It should be recognized that non-90 degree angles may be used in some specialty tile applications, but the discussion here pertains to the more common square/rectangular tile pattern.)

Those skilled in the art will quickly realize that it is indeed possible to align a track A1 and cutting tool C1 with a previously cut line 220 in a way that the new line 222 is perpendicular to the former. Conventional carpenter's squares and/or laser squares may be used for this purpose. However, it will also become quickly clear that the risk of human error is significant when hundreds of lines have to be cut in a short period of time Like with most other cutting operations, cutting into a material is unforgiving, i.e., a wrong cut can't be returned to its original condition. Indeed, while conventional tools are useful, they can not entirely prevent user error, e.g., due to incorrect use of the square or laser correctly, or accidentally positioning the track A1 or cart C1, or even the entire assembly 200, out of alignment with these tools.

Embodiments hereof address this issue by use of one or more side sensors (e.g., optical, proximity, limit switches, etc.) 224 to help ensure proper alignment of the track A1. As shown in FIG. 24, a sensor 224 may be disposed on opposite sides of track A1. The sensors 224 are communicably coupled to a control unit 226 that includes a microprocessor. The control unit 226 is communicably coupled to the grinder D1 and is configured to turn the cutter D1 on or off. If the sensors 224 simultaneously detect the reference line, such as would be the case as shown in FIG. 24, then the control unit 226 determines that the track A1 is properly aligned and actuates the switch to enable the grinder D1 to be turned on. Alternatively, if the sensors 224 do not simultaneously detect the reference line, such as would be the case as shown in FIG. 25, then the control unit determines that the track A1 is mis-aligned, i.e., is not extending orthogonally to cut line 220, and will not enable the grinder D1 to be turned on until the mis-alignment is corrected. It should be noted that a desired orthogonal orientation of the track A1 relative to the reference line may be achieved by placement of sensors 224 directly opposite one another. The skilled artisan will recognize, however, that the sensors 224 may be offset from one another along the length of track A1 when it is desired to orient track A1 obliquely relative to the reference line.

The present invention has been described in particular detail with respect to various possible embodiments, and those of skill in the art will appreciate that the invention may be practiced in other embodiments. First, the particular naming of the components, capitalization of terms, the attributes, or any other structural aspect is not mandatory or significant, and the mechanisms that implement the invention or its features may have different names, formats, or protocols. Also, the particular division of functionality between the various system components described herein is merely exemplary, and not mandatory; functions performed by a single system component may instead be performed by multiple components, and functions performed by multiple components may instead performed by a single component.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims. It should be further understood that any of the features described with respect to one of the embodiments described herein may be similarly applied to any of the other embodiments described herein without departing from the scope of the present invention.

Having thus described the invention, what is claimed is:

1. An apparatus for cutting linear trenches in a concrete ground surface, the apparatus comprising:

a portable frame including at least two ground engaging elongated bars disposed for extending along the concrete ground surface in spaced parallel relation to one another, said bars including a plurality of demarcations and/or slots disposed in spaced relation along lengths thereof, and an elongated track member extending orthogonally relative to said bars, the track member being removably fastened at a proximal end thereof to one of said bars and being removable fastened at a distal end thereof to another of said bars, wherein the track member is selectively movable between a plurality of positions defined by said demarcations and/or slots;

a tool trolley movably engaged with said track member, wherein said tool trolley is configured for moving in a cutting direction along said track member between said proximal end and said distal end;

a motor-driven ground-engageable cutting wheel supported by said tool trolley, said cutting wheel having a cutting wheel axis of rotation being substantially orthogonal to said cutting direction;

a depth adjuster disposed on said tool trolley, the depth adjuster configured to alternately lower and raise the cutting wheel relative to said tool trolley to respectively engage and disengage the cutting wheel from the concrete ground surface; and the tool trolley being configured to follow contours of the concrete ground surface during said moving, wherein when engaged with the concrete ground surface, the cutting wheel cuts a kerf of substantially uniform depth relative to said contours.

2. The apparatus of claim 1, further comprising non-slip pads disposed between the bars and the concrete ground surface.

3. The apparatus of claim 1, wherein the frame comprises a ballast receptacle configured to receive a plurality of ballast plates therein to adjust weight of the apparatus.

4. The apparatus of claim 1, wherein the tool trolley includes an inverted U-shaped receptacle sized and shaped to slidably receive said track member therein, said U-shaped receptacle having side walls with at least portions thereof disposed for sliding surface to surface engagement with said track member to constrain the tool trolley from movement transverse to said cutting direction, and said U-shaped receptacle providing clearance with an upper surface of said track member to permit vertical movement of the tool trolley during said moving in a cutting direction.

5. The apparatus of claim 4, wherein the tool trolley comprises a plurality of ground engaging wheels.

6. The apparatus of claim 1, further comprising a handle operatively engaged with said tool trolley, said handle being engageable by a user for pushing the tool trolley along said track member.

7. The apparatus of claim 6, further comprising a motor configured to drive said cutting wheel.

8. The apparatus of claim 7, wherein the motor and cutting wheel comprise a unitary handheld grinder removably secured to said frame.

9. The apparatus of claim 1, wherein the cutting wheel is disposed within a substantially disc-shaped protective shroud sized and shaped to contain a majority of the cutting wheel therein during said operation.

10. The apparatus of claim 9, further comprising a dust collector communicably coupled to the shroud.

11. The apparatus of claim 10, wherein the dust collector comprises a vacuum device communicably coupled to the shroud via a flexible conduit.

12. The apparatus of claim 1, wherein said cutting wheel has a diameter D in a range of from about 2 inches to about 8 inches, with a cutting portion having a width w in a direction parallel to said cutting wheel axis of rotation within a range of from about ⅛ inches to about ⅜ inches.

13. The apparatus of claim 12, wherein said cutting wheel comprises a segmented grinding wheel having circumferentially spaced metallic segments, the segments each having a cutting surface of convex cross-section in a plane parallel to the cutting wheel axis of rotation.

14. The apparatus of claim 13, wherein said cutting wheel has a diameter D in a range of from about 4 inches to about 5 inches, and said width w is within a range of from about ⅛ inch to about ¼ inch.

15. The apparatus of claim 1, wherein the track member is selectively movable between a plurality of positions defined by said demarcations and/or slots to cut a first plurality of kerfs extending parallel to one another in a first direction.

16. The apparatus of claim 15, configured for being rotated about a vertical axis to cut a second plurality of kerfs extending orthogonally to said first direction.

17. The apparatus of claim 16, further comprising a front sensor operatively engaged with said tool trolley, said sensor communicably coupled with said depth adjuster and with a processor, the front sensor configured to generate a signal when said tool trolley approaches each of said first plurality of kerfs while cutting one of said second plurality of kerfs, and responsive to each signal, said processor configured to actuate said depth adjuster to alternately raise and lower the cutting wheel, wherein said apparatus is configured to cut staggered or offset patterns in the concrete ground surface.

18. The apparatus of claim 16, further comprising first and second side sensors disposed at predetermined locations on opposite sides of said track member, said side sensors communicably coupled with a processor, and said processor communicably coupled to said cutting wheel, the side sensors configured to generate a signal upon detection of one of said first plurality of kerfs, said processor configured to prevent actuation of said cutting wheel unless signals are received from both of said sensors substantially simultaneously, wherein said processor substantially prevents operation of said cutting wheel until a predetermine orientation of said track member relative to the first plurality of kerfs is achieved.

19. A method for restoring a concrete ground surface by forming portions resembling tiles, the method comprising:

(a) providing the apparatus of claim 1;

(b) engaging the extending the ground engaging elongated bars along the concrete ground surface in spaced parallel relation to one another;

(c) extending the elongated track member orthogonally relative to the bars and removably fastening the proximal end to one of the bars and removably fastening the distal end thereof to the other of the bars;

(d) movably engaging the tool trolley with the track member;

(e) actuating the cutting wheel;

(f) actuating the depth adjuster to engage the cutting wheel with the concrete ground surface to cut a kerf;

(g) moving the tool trolley in a cutting direction along the track member between the proximal end and the distal end to cut a kerf extending in a first direction.

20. The method of claim 19, wherein said actuating (e) further comprises actuating a motor to drive said cutting wheel.

21. The method of claim 19, further comprising disposing one or more ballast plates on a ballast receptacle of the frame to adjust the weight of the apparatus.

22. The method of claim 19, further comprising filling the kerf with grout or mortar.

23. The method of claim 22, further comprising applying color in the form of paint, stain and/or dye to the concrete ground surface and/or to the grout or mortar.

24. The method of claim 19, further comprising repeating said steps (c)-(g) with the track member at a plurality of spaced locations along lengths of the bars to cut a first plurality of kerfs extending parallel to one another in the first direction.

25. The method of claim 24, further comprising rotating the bars and track member about a vertical axis and repeating said steps (c)-(g) with the track member at a plurality of spaced locations along lengths of the bars to cut a second plurality of kerfs extending parallel to one another in a second direction.

26. The method of claim 25, wherein the first direction is orthogonal to the second direction.

27. The method of claim 26, further comprising during said step (c), using first and second side sensors disposed on opposite sides of the track member to generate a signal upon detection of one of the first plurality of kerfs, and using a processor to prevent actuation of the cutting wheel unless signals are received from both of said sensors substantially simultaneously, wherein the processor substantially prevents operation of the cutting wheel until a predetermine orientation of said track member relative to the first plurality of kerfs is achieved.

28. The method of claim 27, further comprising using a front sensor operatively engaged with the tool trolley to generate a signal when the tool trolley approaches each of the first plurality of kerfs while cutting one of the second plurality of kerfs, and using a processor responsive to each signal, to actuate the depth adjuster to alternately raise and lower the cutting wheel, wherein staggered or offset patterns are cut in the concrete ground surface.

* * * * *